US007389661B2

(12) United States Patent
Viviano et al.

(10) Patent No.: US 7,389,661 B2
(45) Date of Patent: Jun. 24, 2008

(54) KEYLESS DEADBOLT DOOR LOCK ASSEMBLY

(76) Inventors: Robert J. Viviano, 6736 Itaska St., St. Louis, MO (US) 63141; Robert D. Boehlow, 1463 Scenic Dr., Herculaneum, MO (US) 63048

( * ) Notice: Subject to any disclaimer, the term of this patent is extended or adjusted under 35 U.S.C. 154(b) by 189 days.

(21) Appl. No.: 11/102,180

(22) Filed: Apr. 7, 2005

(65) Prior Publication Data

US 2006/0065025 A1 Mar. 30, 2006

Related U.S. Application Data

(60) Provisional application No. 60/612,841, filed on Sep. 24, 2004.

(51) Int. Cl.
*E05B 9/10* (2006.01)

(52) U.S. Cl. ..... 70/379 R; 70/190; 70/224; 70/381

(58) Field of Classification Search ..... 70/104, 70/124, 129, 134, 190, 224, 379 R, 424, 128, 70/381, DIG. 31; 292/336.3, 347, 356, 357
See application file for complete search history.

(56) References Cited

U.S. PATENT DOCUMENTS

| | | | |
|---|---|---|---|
| 1,048,528 | A | 12/1912 | Woolsey |
| 2,074,244 | A | 3/1937 | Thurber |
| 2,188,149 | A | 1/1940 | Kaiser |
| 3,025,694 | A | 3/1962 | George |
| 3,584,484 | A | 6/1971 | Hallmann et al. |
| 3,593,548 | A | 7/1971 | Kendrick |
| 3,779,052 | A | 12/1973 | Deitch |
| 3,881,331 | A | 5/1975 | Tranberg et al. |
| 3,896,644 | A | 7/1975 | Nagy et al. |
| 3,896,645 | A | 7/1975 | Nagy et al. |
| 3,990,277 | A | 11/1976 | Mullich |
| 4,038,846 | A | 8/1977 | Klann |
| 4,073,527 | A | 2/1978 | Schlage |
| 4,148,092 | A | 4/1979 | Martin |
| 4,169,616 | A | 10/1979 | Peterson |
| 4,236,396 | A | 12/1980 | Surko, Jr. et al. |

(Continued)

FOREIGN PATENT DOCUMENTS

| | | |
|---|---|---|
| WO | WO 03/078767 A1 | 9/2003 |

*Primary Examiner*—Patricia Engle
*Assistant Examiner*—Christopher Boswell
(74) *Attorney, Agent, or Firm*—Polster, Lieder, Woodruff & Lucchesi, L.C.

(57) ABSTRACT

A deadbolt door lock assembly operates a deadbolt between an unlocked and locked position. It generally comprises an actuator, a ring, and a biasing member. The ring contacts the actuator and rotates it in either a clockwise or counter-clockwise direction to lock the deadbolt. Once the deadbolt is locked, the biasing member urges the ring out of contact with the actuator. In one aspect, the assembly is operable in either the clockwise or counter-clockwise direction without disconnecting the biasing member. In another aspect, the biasing member includes different portions to urge the ring out of contact with the actuator depending on whether ring operation is in a clockwise or counter-clockwise direction. The assembly may include a backstop to indicate rotational direction of the ring to lock the deadbolt. The assembly may also include a stabilizing bridge to inhibit transverse rotation of mounting screws that secure the assembly to a door.

31 Claims, 27 Drawing Sheets

U.S. PATENT DOCUMENTS 4,290,282 A 9/1981 Wildenradt
4,297,862 A 11/1981 Solovieff
4,300,374 A 11/1981 Mullich et al.
4,306,466 A 12/1981 Coveney
4,414,828 A 11/1983 Takinami et al.
4,631,944 A 12/1986 Gater et al.
4,690,073 A 9/1987 Shoop
4,709,566 A 12/1987 Wildenradt
4,712,396 A 12/1987 Cary et al.
4,739,639 A 4/1988 Balasingam
4,745,784 A 5/1988 Gartner
4,798,065 A 1/1989 DeForrest, Sr.
4,854,143 A 8/1989 Corder et al.
4,866,961 A 9/1989 Yang
4,901,544 A 2/1990 Jang
4,903,512 A 2/1990 Leroy et al.
5,010,749 A 4/1991 Lin
5,039,062 A 8/1991 England et al.
5,040,652 A 8/1991 Fish et al.
5,060,991 A 10/1991 Davidian et al.
5,085,063 A 2/1992 Van Dyke et al.
5,118,152 A 6/1992 Lin
5,150,592 A 9/1992 Lin
5,152,363 A 10/1992 Mertens et al.
5,177,987 A 1/1993 Shen
5,186,030 A 2/1993 Lin
5,193,370 A 3/1993 Norden
5,199,285 A 4/1993 Lin
5,216,908 A 6/1993 Malvy
5,265,924 A 11/1993 Kim
5,404,734 A 4/1995 Martinez
5,481,890 A 1/1996 Millman
5,531,086 A 7/1996 Bryant
5,544,507 A 8/1996 Lin
5,556,144 A * 9/1996 Lin ..... 292/336.3
5,617,749 A 4/1997 Park
5,666,833 A 9/1997 Gao et al.
5,722,273 A 3/1998 Lin et al.
5,797,286 A 8/1998 Armstrong
5,813,261 A 9/1998 Boehlow
5,813,708 A 9/1998 Shen
5,934,122 A * 8/1999 Edwards et al. ..... 70/224
6,145,358 A * 11/2000 Wu ..... 70/467
6,216,502 B1 4/2001 Cannella et al.
6,286,347 B1 9/2001 Frolov
6,601,420 B1 8/2003 Boehlow
6,651,468 B2 11/2003 Aramburu et al.
2001/0028172 A1 10/2001 Bates et al.

* cited by examiner

KEYLESS DEADBOLT DOOR LOCK ASSEMBLY

CROSS-REFERENCE TO RELATED APPLICATION

This application claims the benefit of U.S. Provisional Application Ser. No. 60/612,841, filed Sep. 24, 2004, and entitled REVERSIBLE KEYLESS DEADBOLT LOCK ASSEMBLY, the entire disclosure of which is hereby incorporated by reference.

BACKGROUND OF THE INVENTION

This invention relates to deadbolt door lock assemblies, and in particular to such a door lock assembly in which the deadbolt is configured for keyless operation to lock the deadbolt.

Deadbolt door lock assemblies are commonly installed on entry doors of commercial and residential buildings to lock the doors closed and to provide increased security against unwanted entry. In such lock assemblies, a deadbolt is selectively positionable between an unlocked position and a locked position. In the unlocked position, the deadbolt is recessed into the door, allowing the door to open. In the locked position, the deadbolt extends out from the door for disposition within an opposing door frame jamb (when the door is closed), thereby locking the door closed.

Single cylinder and double cylinder deadbolt lock assemblies may be used. Both generally include an oscillating crank to actuate the deadbolt between the unlocked and locked positions. In the single cylinder assembly, a torque blade connects the crank to a thumbturn mounted on the inside facing surface of the door (e.g., accessible from within the building) and to a lock cylinder accessible from the outside surface of the door. The thumbturn can be manually turned or a key can be used to operate the lock cylinder to rotate the torque blade and actuate the deadbolt between its unlocked and locked positions. In the double cylinder assembly, the torque blade operatively connects the crank to two lock cylinders, one on each of the inside and outside surfaces of the door. Keys are used with both lock cylinders to operate the deadbolt.

While it is known that deadbolt door locks provide improved security, people often do not use them after closing the door from outside because it requires finding the correct key to operate the lock cylinder. To remedy this, some deadbolt lock assemblies allow keyless locking operation from outside the door to lock the deadbolt. Examples are disclosed in U.S. Pat. No. 3,593,548 (Kendrick), U.S. Pat. No. 5,010,749 (Lin), U.S. Pat. No. 5,150,592 (Lin), U.S. Pat. No. 5,186,030 (Lin), and U.S. Pat. No. 5,797,286 (Armstrong). These deadbolt door lock assemblies typically include a ring surrounding the lock cylinder in operative connection with the torque blade to actuate the deadbolt to its locked position without having to use a key.

One drawback of these prior deadbolt door lock assemblies is that they are susceptible to binding or jamming during subsequent unlocking of the deadbolt. In particular, the ring tends to interfere with the rotation of the torque blade back to a position corresponding to the unlocked position of the deadbolt. In addition, the force necessary to overcome binding of the lock accelerates wear of the internal mechanisms of the assembly. Another disadvantage of some prior keyless deadbolt lock devices is that projection of the deadbolt may be dependent on the rotational speed imparted by the user to the ring. In such a design, the deadbolt may not fully project to its locked position, leaving the lock easily retracted without a key.

To this end, co-assigned U.S. Pat. Nos. 5,813,261 and 6,601,420, the entire disclosures of which are incorporated by reference herein, disclose keyless deadbolt door lock assemblies that inhibit binding upon unlocking of the deadbolt. In particular, the keyless ring is used to actuate the torque blade to move the deadbolt to its locked position, and is then returned to its initial position by a biasing member so that the ring cannot interfere with subsequent movement of the torque blade (e.g., by using a key) back to the unlocked position of the deadbolt.

However, the lock assemblies disclosed in these references are generally useable on only a left hand door or a right hand door. Thus, two different models must be made available (one for use with a left hand door and one for use with a right hand door). Alternatively, the disclosed lock assembly may be disassembled, substantially reconfigured and reassembled to switch from use on a left hand door to use on a right hand door (or vice-versa).

There is a need, therefore, for a keyless deadbolt door lock assembly which is operable on either a left hand door or a right hand door with little or no reconfiguration, and is less susceptible to binding during unlocking of the deadbolt.

SUMMARY OF THE INVENTION

The invention is directed toward a deadbolt door lock assembly for keyless operation of a deadbolt from an unlocked position to a locked position of the deadbolt. In one aspect of the invention, the assembly generally comprises an actuator, a ring, an actuator contact mechanism, and a biasing member. The actuator is operatively connected to the deadbolt and has a rotation axis. The actuator is rotatable about its rotation axis from an unlocked position corresponding to the unlocked position of the deadbolt to a locked position corresponding to the locked position of the deadbolt. The ring of the assembly is rotatable relative to the actuator from an initial position to a rotated position, and the actuator contact mechanism is operatively connected to the ring for conjoint rotation. The actuator contact mechanism is configured and arranged for contact with the actuator in the unlocked position of the actuator. When the ring rotates from its initial position toward its rotated position, the actuator contact mechanism rotates therewith and rotates the actuator from its unlocked position to its locked position. In the locked position of the actuator, the biasing member urges the actuator contact mechanism away from contact with the actuator. This operation of the lock assembly to lock the deadbolt can take place in either a clockwise operating mode or a counter-clockwise operating mode. In the clockwise operating mode, the ring is rotatable in a clockwise direction to rotate the actuator from its unlocked position to its locked position (to lock the deadbolt). In the counter-clockwise operating mode, the ring is rotatable in the counter-clockwise direction to rotate the actuator to its locked position. The lock assembly is operable between these operating modes without removing the biasing member from the assembly.

In another aspect of the invention, a deadbolt door lock assembly for keyless operation of a deadbolt from an unlocked position to a locked position of the deadbolt generally comprises an actuator, a ring, an actuator contact mechanism, and a biasing member. The actuator is operatively connected to the deadbolt and has a rotation axis. The actuator is rotatable about its rotation axis from an unlocked position corresponding to the unlocked position of the deadbolt to a locked position corresponding to the locked position of the deadbolt. The ring of the assembly is rotatable relative to the actuator from an initial position to a rotated position, and the actuator contact mechanism is operatively connected to the ring for conjoint rotation. The actuator contact mechanism is configured and arranged for contact with the actuator in the unlocked position of the actuator. When the ring rotates from its initial position toward its rotated position, the actuator contact mechanism rotates therewith and rotates the actuator from its unlocked position to its locked position. In the locked position of the actuator, the biasing member urges the actuator contact mechanism away from contact with the actuator. This operation of the lock assembly to lock the deadbolt can take place in either a clockwise operating mode or a counter-clockwise operating mode. In the clockwise operating mode, the ring is rotatable in a clockwise direction to rotate the actuator from its unlocked position to its locked position (to lock the deadbolt). In the counter-clockwise operating mode, the ring is rotatable in the counter-clockwise direction to rotate the actuator to its locked position. A first portion of the biasing member applies a biasing force to the ring generally in the counter-clockwise direction in response to clockwise rotation of the ring in the clockwise operating mode. A second portion of the biasing member different from the first portion applies a force to the ring generally in the clockwise direction in response to counter-clockwise rotation of the ring in the counter-clockwise operating mode.

In still another aspect of the invention, a deadbolt door lock assembly for keyless operation of a deadbolt from an unlocked position to a locked position of the deadbolt generally comprises an actuator, a ring, an actuator contact mechanism, and a backstop. The actuator is operatively connected to the deadbolt and has a rotation axis. The actuator is rotatable about its rotation axis from an unlocked position corresponding to the unlocked position of the deadbolt to a locked position corresponding to the locked position of the deadbolt. The ring of the assembly is rotatable relative to the actuator from an initial position to a rotated position, and the actuator contact mechanism is operatively connected to the ring for conjoint rotation. The actuator contact mechanism is configured and arranged for contact with the actuator in the unlocked position of the actuator. When the ring rotates from its initial position toward its rotated position, the actuator contact mechanism rotates therewith and rotates the actuator from its unlocked position to its locked position. The operation of the lock assembly to lock the deadbolt can take place in either a clockwise operating mode or a counter-clockwise operating mode. In the clockwise operating mode, the ring is rotatable in a clockwise direction to rotate the actuator from its unlocked position to its locked position (to lock the deadbolt). In the counter-clockwise operating mode, the ring is rotatable in the counter-clockwise direction to rotate the actuator to its locked position. The backstop indicates whether the assembly is operable in the clockwise operating mode or the counter-clockwise operating mode. In a first configuration, the backstop inhibits counter-clockwise rotation of the ring from its initial position to indicate assembly operation in the clockwise operating mode. In a second configuration, the backstop inhibits clockwise rotation of the ring from its initial position to indicate assembly operation in the counter-clockwise operating mode.

In a further aspect of the invention, a deadbolt door lock assembly for operation of a deadbolt between an unlocked position and a locked position of the deadbolt generally comprises a lock cylinder, a torque blade, a locator, at least one mounting screw, and a stabilizing bridge. The torque blade is operatively connected to the lock cylinder and extends longitudinally therefrom. The torque blade is also operatively connected to the deadbolt whereby the lock cylinder can operate to move the deadbolt between its unlocked and locked positions. The locator locates the lock assembly on a door, and the mounting screw mounts the lock assembly on the door. The stabilizing bridge has an opening corresponding to the mounting screw such that the screw extends through the stabilizing bridge upon securing the lock assembly on the door. The stabilizing bridge inhibits rotational movement of the mounting screw in a direction transverse to a longitudinal axis of the mounting screw.

Other features of the invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE INVENTION

Figure 1:
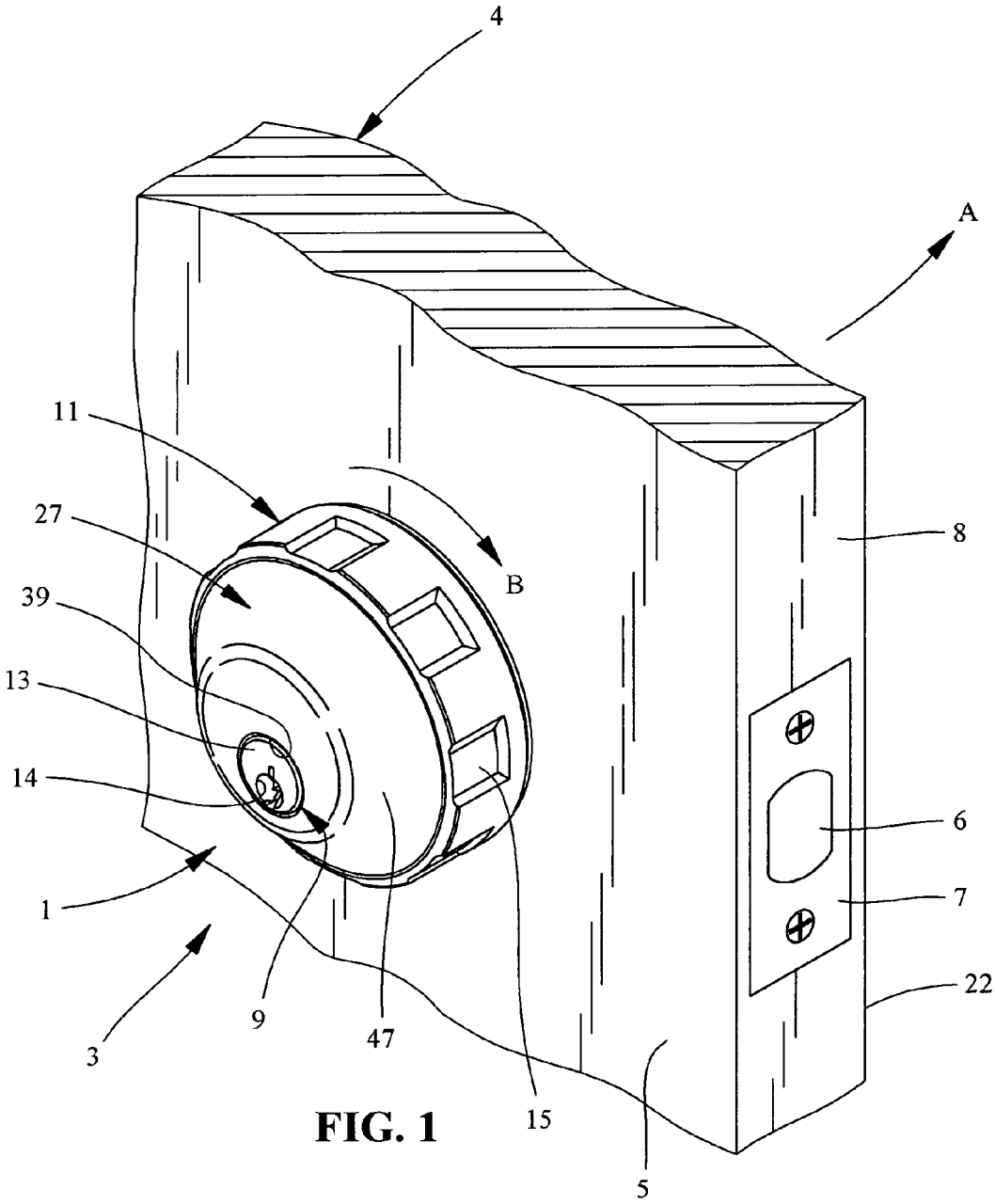
FIG. 1 is a perspective of a keyless deadbolt lock assembly according to a first embodiment of the present invention shown installed on an outer surface of an in-swinging left-hand door.

Referring to the drawings and in particular to FIG. 1, a keyless deadbolt door lock assembly according to a first embodiment of the present invention is indicated generally at 1 and is illustrated as being installed on an in-swinging, left-hand door, indicated generally at 4. As is well known in the art, the door 4 is hingedly mounted on a door frame (not shown) so that the door is capable of hinged movement between an open position and a closed position in which a free side 8 (the side opposite the hinged side) of the door is in opposed relationship with a door jamb (not shown). In the illustrated embodiment of FIG. 1, the lock assembly 1 is mounted on an outside surface 5 of the in-swinging door 4 (i.e., the surface that is accessible from exterior of a building on which the door is mounted). The door 4 opens into the building, e.g., in the direction indicated by arrow A in FIG. 1. It is understood, however, that the lock assembly 1 may be mounted on an inside surface 22 of the door 4. It is also understood that the lock assembly 1 may be mounted on an outside surface or inside surface of an out-swinging door, which would open in a direction opposite to that indicated by arrow A, without departing from the scope of the invention.

Figure 3:
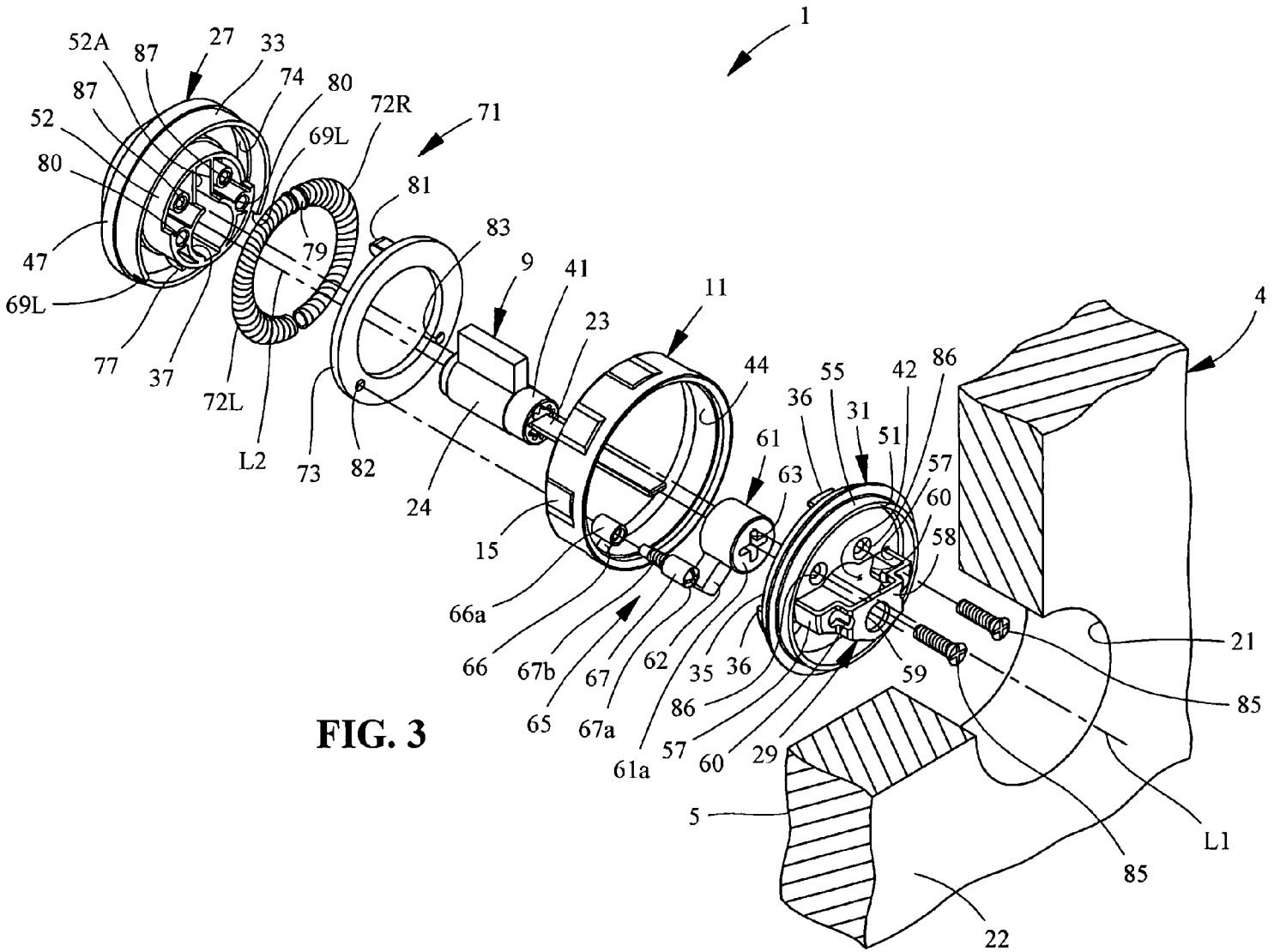
FIG. 3 is an exploded perspective of the lock assembly of FIG. 1.

As used to described various embodiments herein, the terms "inner," "inward," "outer" and "outward," without being preceded by the term "radial" refer to the longitudinal direction of the lock assembly, and more particularly refer to the relative positions of the various components of the lock assemblies as viewed from the door looking outward through the lock assembly (e.g., from right to left in FIG. 3). The terms "radial" and "radially", including the terms "radially inward," "radially inner," "radially outward" and radially outer," refer to a direction transverse to the longitudinal direction of the lock assembly 1. The above terms otherwise do not require any particular orientation of the lock assembly 1 on the door 4.

Figure 2:
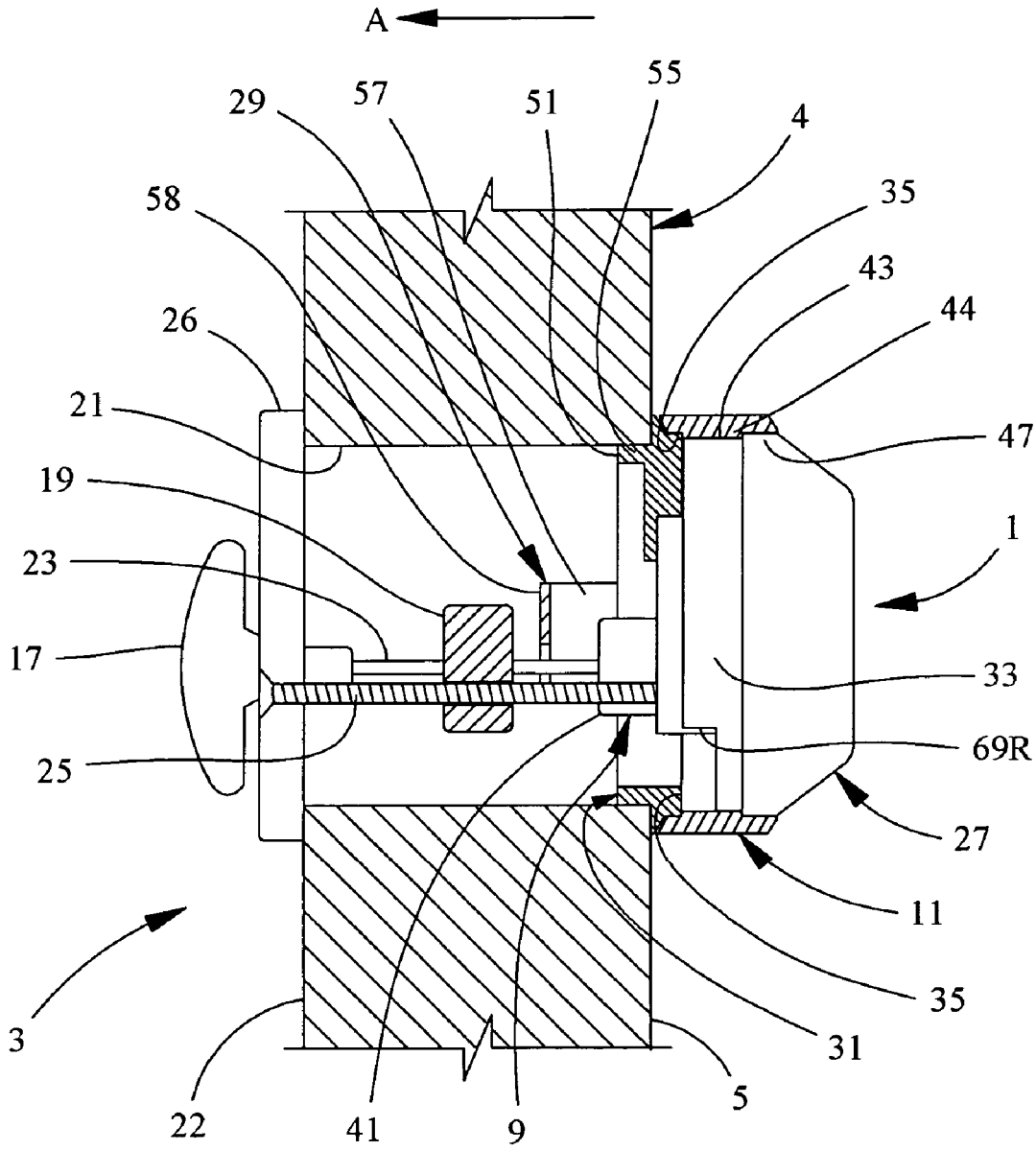
FIG. 2 is a partial cross-section of the lock assembly and door of FIG. 1.

The lock assembly 1 is operatively connected to a deadbolt apparatus, indicated generally at 3, having a deadbolt 6 that is moveable between an unlocked position and a locked position. In the unlocked position shown in FIG. 1 (and FIGS. 2, 5A, 5B, and 9), the deadbolt 6 is recessed into the free side 8 of the door 4 and sits flush with a plate 7 mounted on the free side of the door. In the locked position (FIGS. 7, 8, and 10), the deadbolt 6 extends out from the door 4 and into the opposing door jamb of the door frame (not shown) to lock the door closed. With particular reference to FIG. 2, the deadbolt apparatus 3 particularly comprises a deadbolt backset 19 (shown schematically in cross-section in FIG. 2) housing the deadbolt 6 (not shown in FIG. 2) and including a suitable mechanism (e.g., an oscillating crank) for moving the deadbolt relative to the door 4 between its unlocked and locked positions. The construction and operation of such deadbolt apparatus 3 is well known in the art and will not be described further herein except to the extent necessary to disclose the present invention.

As illustrated best in FIG. 2 and the exploded view of FIG. 3, the lock assembly 1 generally comprises a locator, indicated generally at 31, for positioning the lock assembly on the outside surface 5 of the door 4 at a door cutout 21, a lock cylinder, indicated generally at 9, disposed outward of the locator 31 and operatively connected to a torque blade 23 that extends inward from the lock cylinder through the locator and the door cutout 21, a body, indicated generally at 27, housing a key tumbler 24 of the lock cylinder 9, and a ring, indicated generally at 11, extending between and surrounding respective portions of the body 27 and the locator 31 to enclose the lock cylinder 9 and other operating components of the lock assembly 1 against unwanted access. A back plate 26 and thumbturn 17 are mounted on the inside surface 22 of the door 4 with the thumbturn operatively connected with the torque blade 23 of the lock cylinder 9.

The deadbolt backset 19 is operatively connected with the torque blade 23 such that rotation of the torque blade operates to move the deadbolt 6 between its unlocked and locked positions. The key tumbler 24 of the tumbler lock cylinder 9 includes a faceplate 13 (FIG. 1) having a keyhole 14 formed therein. A key (not shown) operates the key tumbler 24 to rotate the torque blade 23 and thereby operate the deadbolt backset 19 to move the deadbolt 6 between its unlocked and locked positions. Rotation of the thumbturn 17 may also be used to rotate the torque blade 23 to move the deadbolt 6 between its unlocked and locked positions. That is, both the key tumbler 24 and the thumbturn 17 may be used to move the deadbolt 6 from its unlocked position to its locked position, and from its locked position to its unlocked position. In the illustrated embodiment in which the lock assembly 1 is mounted on the left-hand door 4, the key rotates in the direction indicated by arrow B in FIG. 1 to lock the door 4 and rotates in an opposite direction to unlock the door. It is understood that the thumbturn 17 may be replaced by a second lock cylinder 9 operatively connected to the torque blade 23 so that a key is useable from both inside and outside the door to lock and unlock the deadbolt 6.

Figure 4:
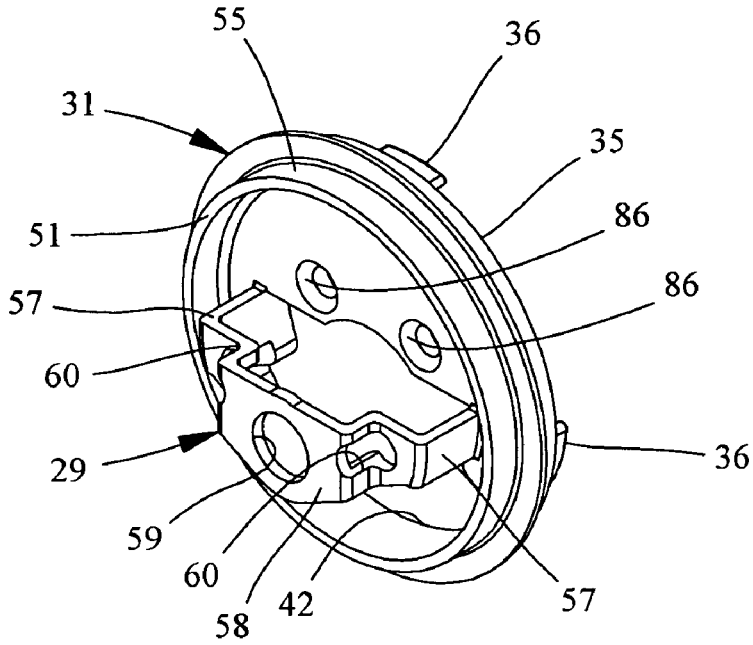
FIG. 4 is a rear perspective of a locator of the lock assembly of FIG. 1.

The locator 31, which is also shown in FIG. 4, is generally circular and has an annular flange 55 extending inward from the locator and sized radially smaller than the peripheral edge of the locator to define an inner shoulder 51. The shoulder 51 locates the locator 31 on the door 4 at the cutout 21, with the flange 55 providing a relatively secure fit against the inner surface of the cutout and the locator abutting against the outside surface of the door. In one suitable embodiment, the shoulder 51 formed by the flange 55 is sized to fit a standard size door lock cutout, for example about a 2.125 in. (5.3975 cm) diameter cutout. However, the locator 31, and/or the shoulder 51 thereof, may be sized to fit a different size door lock cutout, e.g., having a diameter other than about 2.125 in. (5.3975 cm), without departing from the scope of the invention.

The locator 31 also has an outward facing shoulder 35 formed radially inward of the locator peripheral edge for use in positioning the body 27 of the lock assembly 1 on the locator 31. Three tabs, each indicated at 36 (only two are visible in the drawings), extend outward from the locator 31 in symmetrically spaced relationship with each other radially inward of the shoulder 35 for frictionally engaging the body 27 of the lock assembly 1 to further locate the body on the locator 31 during assembly.

As shown in FIGS. 2-4, the locator 31 of the illustrated embodiment also has a stabilizing bridge, indicated generally at 29, connected to and extending inward from the locator, e.g., within the cutout 21 between the locator and deadbolt backset 19. The stabilizing bridge 29 is generally C-shaped. It includes two legs 57 connected to the locator 31 radially inward of the inner shoulder 51, in spaced relationship with each other, and a bridge plate 58 spanning the two legs. The stabilizing bridge 29 has a central opening 59 suitably sized for receiving the torque blade 23 of the lock cylinder 9 therethrough, and a pair of laterally spaced openings 60 sized for receiving mounting screws 25 (FIG. 2, only one screw is visible) therethrough as described later herein. In the illustrated embodiment, the legs 57 are formed integral with the locator 31. However, the legs 57 may be formed separately from the locator 31 and connected thereto, as by welding or other fastening technique. It is also understood that the stabilizing bridge 29 may be omitted from the locator 31 without departing from the scope of this invention.

The body 27 comprises a generally bell-shaped, or bowl-shaped end plate 47, an arcuate flange 33 (FIGS. 2 and 3) extending inward from the end plate generally adjacent to, but radially offset inward from, the periphery of the end plate 47, an annular flange 52 extending inward from the end plate and spaced radially inward of the arcuate flange 33 to define a generally annular channel 74 therebetween, and opposed ribs (each indicated at 52*a*) within the annular flange 52 configured and spaced from each other to define (along with the annular flange) a channel 37 shaped for receiving the lock cylinder 9 to hold the cylinder against rotation during use.

The end plate 47 has an opening 39 (FIG. 1) therein and the faceplate 13 of the lock cylinder 9 sits in the channel 37 substantially flush with the end plate at the opening to provide access to the keyhole 14. The lock cylinder channel 37 of the body 27 is suitably sized smaller in length than the tumbler lock 24 of the lock cylinder 9 such that an inner end 41 of the tumbler lock extends inward beyond the channel 37 to a position generally within a semi-circular opening 42 formed in the locator 31.

Upon assembly of the body 27 together with the locator 31 in the manner described later herein, the arcuate flange 33 of the body abuts against the outer facing circumferential shoulder 35 of the locator 31 such that the periphery of the body end plate 47, the arcuate flange 33 thereof, and the outer facing circumferential shoulder 35 of the locator 31 together define a race 43 (FIG. 2) for slidably receiving the ring 11 on the assembly 1 such that the ring is rotatable relative to the body 27 and locator 31 within the race.

As illustrated best in FIGS. 3 and 5A-6, a torque blade actuator, indicated generally at 61, is mounted on the torque blade 23 generally within the semi-circular opening 42 of the locator 31, slightly outward of the stabilizing bridge 29. The actuator 61 has a generally cup-shaped member 61*a* sized to seat on the inner end 41 of the lock cylinder key tumbler 24. A slot, and more suitably a cross-shaped slot 63 as illustrated in FIG. 3, is formed in the cup-shaped member 61*a* for receiving the torque blade 23 therethrough so as to operatively connect the torque blade with the actuator 61.

The actuator 61 also has an arm 62 extending radially outward from the cup-shaped member 61*a* for reasons which will become apparent. In the illustrated embodiment, the arm 62 is formed integrally with the actuator 61. However, the arm 62 may be formed separate from the cup-shaped member 61*a* and connected thereto, either by being affixed thereto or releasably secured thereto, without departing from the scope of this invention. It is also contemplated that the actuator may be mounted on the torque blade 23 other than by a cup-shaped member as long as the actuator is operatively connected to the torque blade.

Figure 7:
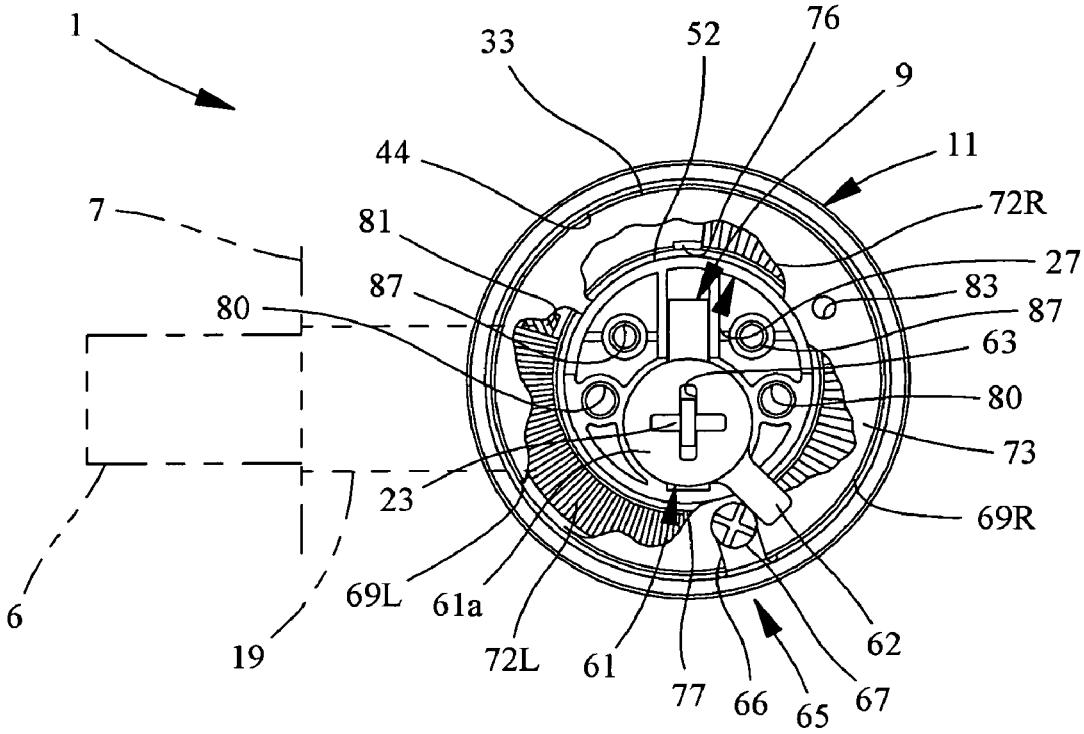
FIG. 7 is an end view similar to FIG. 5A with the ring in a rotated position and the actuator in a locked position.

The actuator 61 is capable of rotation relative to the body 27, key tumbler 24 and locator 31 about a rotation axis L2 (FIG. 3) of the actuator (which in the illustrated embodiment is coincident with the torque blade 23 and below a longitudinal axis L1 of the assembly 1) to conjointly rotate the torque blade for selectively positioning the deadbolt 6. In particular, the actuator 61 is suitably rotatable between an unlocked position (e.g., as shown in FIGS. 5A and 5B) corresponding to the unlocked position of the deadbolt 6 and a locked position (e.g., as shown in FIG. 7) corresponding to the locked position of the deadbolt as will be described later herein.

With particular reference to FIG. 3, the ring 11 has an annular inner surface configured to form a guide 44 sized for slidably seating within the annular race 43 (FIG. 2) formed by the periphery of the body end plate 47, the arcuate flange 33 thereof, and the outer facing circumferential shoulder 35 of the locator. The slidable arrangement of the guide 44 in the race 43 permits rotation of the ring 11 relative to the body 27, the locator 31, and the actuator 61. The ring 11 of the illustrated embodiment of FIG. 1 has multiple square-shaped indentations 15 formed in its outer surface to facilitate gripping the ring 11 for manually rotating the ring to lock the deadbolt without having to use a key.

Figure 5A:
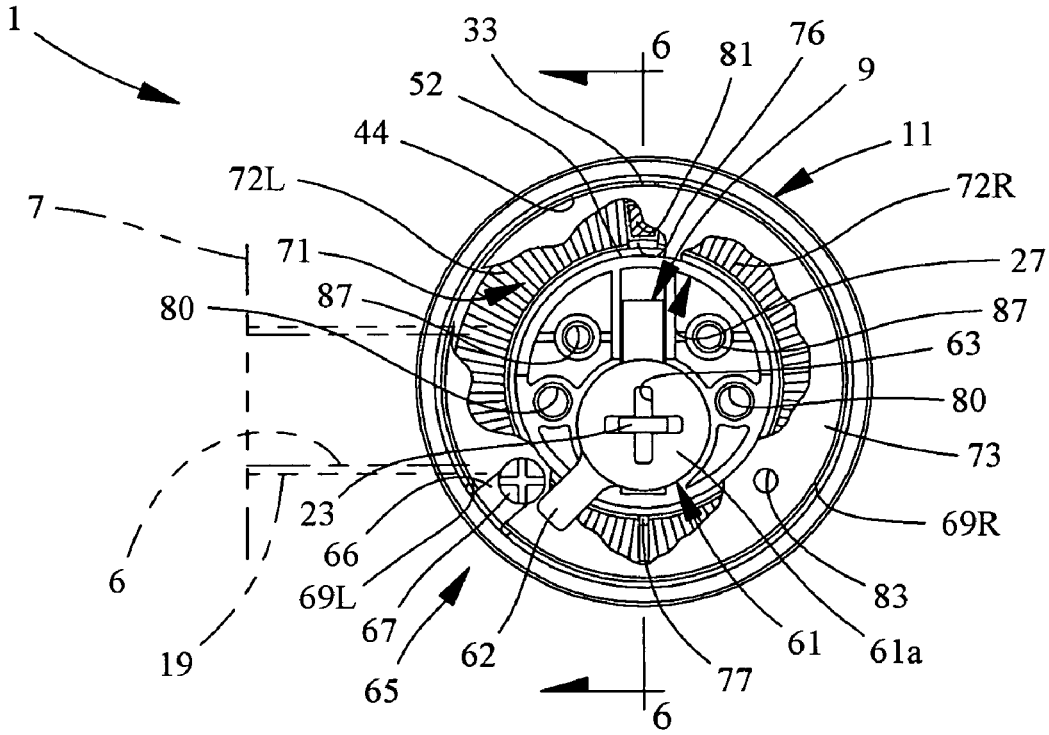
FIG. 5A is an end view of the lock assembly of FIG. 1 as viewed looking outward from the door, with a portion of the lock assembly broken away to show internal construction, the lock assembly being in a counter-clockwise operating mode with a ring of the lock assembly in an initial position and an actuator in an unlocked position.
Figure 5B:
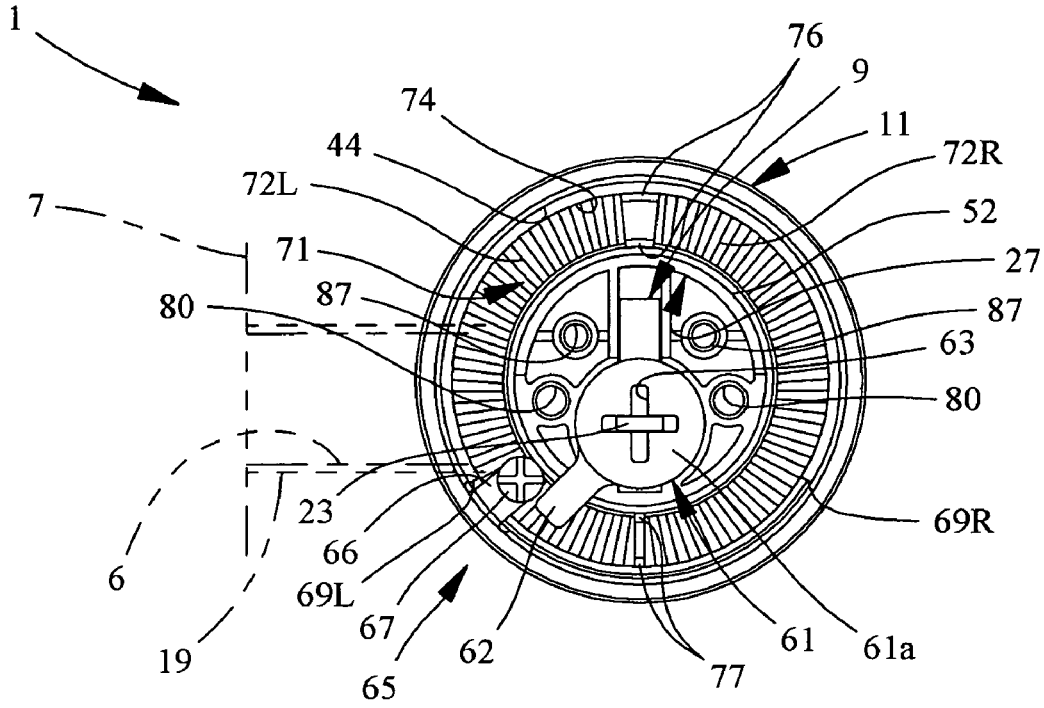
FIG. 5B is an end view similar to FIG. 5A with components of the lock assembly omitted to shown internal construction.
Figure 6:
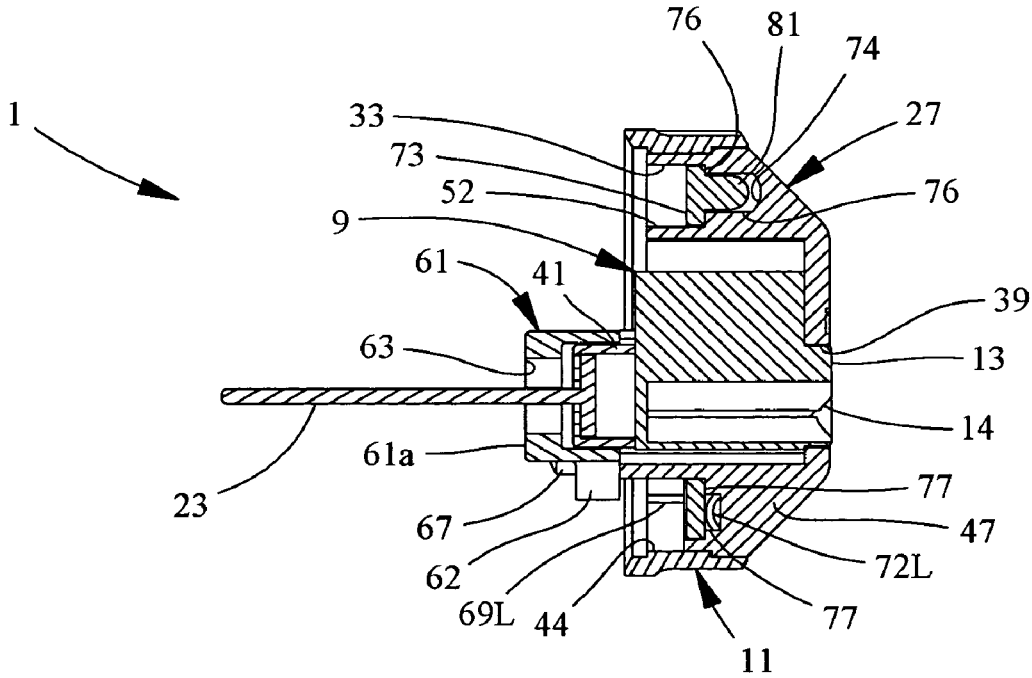
FIG. 6 is a cross-section taken in the plane of line 6-6 of FIG. 5A.

As shown best in FIGS. 5A-6, the ring 11 has an actuator contact mechanism, generally indicated at 65, operatively connected thereto, and more suitably directly connected thereto, for conjoint rotation with the ring 11 and for contacting and moving the actuator 61 from its unlocked position to its locked position upon rotation of the ring. In the illustrated embodiment of FIGS. 3 and 5A, the actuator contact mechanism 65 comprises a finger 66 extending radially inward from the annular guide 44 on the inner surface of the ring 11. The finger 65 is generally cylindrically-shaped at its radially inner (e.g., free) end, with a threaded bore 66*a* extending therethrough. The contact mechanism 65 further comprises a threaded pin 67 threadably (e.g., releasably) received in the bore 66*a* as illustrated in FIGS. 3 and 5A. The head 67*a* of the pin 67 extends inward from the finger 65 while the opposite, threaded end 67*b* of the pin extends slightly outward of the finger for reasons which will become apparent.

The locking assembly 1 further comprises a biasing member, generally indicated at 71, operatively connected to the ring 11 to return the ring back to an initial or set position following rotation of the ring to lock the deadbolt 6. The illustrated biasing member 71 comprises a pair of coiled springs 72L and 72R and an annular (e.g., washer-shaped) plate 73 as shown in FIGS. 3 and 5A (the plate 73 is partly broken away in FIG. 5A). With reference to FIG. 5B, the springs 72L, 72R seat within the annular channel 74 formed in the body 27. In particular, the springs 72L and 72R are seated in the annular channel 74 with the respective opposed ends of the springs separated from each other by and butting against an upper pair (in the orientation illustrated in FIG. 5B)

of radially spaced spring seats 76 formed at the top of the annular channel 74 and a respective lower pair of radially spaced spring seats 77 formed at the bottom of the annular channel of the body 27. A plug 79 may be inserted into the ends of each spring 72L, 72R to provide additional surface area to the ends of the spring for abutting against the spring seats 76, 77 in the annular channel 74.

The annular plate 73 of the biasing member 71 also seats within the annular channel 74 of the body, over the springs 72L, 72R, to retain the springs within the channel. A pair of openings 82, 83 is formed in the annular plate 73 in angularly spaced relationship with each other for releasably receiving a tip of the threaded end 67*b* of the actuator contact mechanism pin 67 to operatively connect the biasing member 71 to the ring 11. A tab 81 extends outward from the annular plate 73 to fit between the opposed upper ends of the springs 72L, 72R and radially between the radially spaced spring seats 76 formed at the top of the annular channel 74 of the body 27.

In one suitable embodiment, the lock assembly 1 may be assembled generally in the order in which the various components are illustrated from left to right in FIG. 3. However, the order in which the various components of the lock assembly 1 are assembled may vary without departing from the scope of this invention. To secure the lock assembly 1 components together, a pair of threaded screw fasteners, each indicated at 85, extend outward through respective openings 86 formed in the locator 31 and are threadably received in corresponding internally threaded mounting members 87 extending inward from the body 27. When tightened, the screws 85 draw and hold the arcuate flange 33 of the body 27 tight against the outer shoulder 35 of the locator 31 to secure the lock assembly 1 components together as a unit.

The lock assembly 1 may then be mounted on a door, such as the door 4 shown in FIGS. 1 and 2, by inserting the lock assembly, torque blade 23 and locator 31 first, inward into the door cutout 21 on the outside surface 5 of the door such that the torque blade 23 extends through the cutout 21 and deadbolt backset 19 (e.g., to operatively connect the deadbolt 6 to the torque blade) toward the inside surface 22 of the door 4. The inner annular shoulder 51 of the locator 31 receives the inner surface of the door cutout 21 to properly locate the assembly on the door 4.

With reference to FIGS. 2 and 3, the back plate 26 and thumbturn 17 are mounted on the inside surface 22 of the door 4 with the thumbturn operatively connected with the torque blade 23. The two threaded mounting screws 25 extend through the back plate 26, through the cutout 21, the laterally spaced openings 60 formed in the stabilizing bridge 29 of the locator 31, and through the ring 11 and biasing member 71, and are threadably received by internally threaded openings 80 in the body 27. Tightening the mounting screws 25 pulls the lock assembly 1 and back plate 26 toward each other to secure the various lock assembly and thumbturn 17 components on the door 4.

The lock assembly 1 is suitably operable in either a clockwise operating mode or a counter-clockwise operating mode depending on whether the lock assembly is used on a left-hand door or a right-hand door. It is contemplated that a lock assembly could be modified so that it could operate in either a clockwise or counter-clockwise mode on a left-hand door. It is contemplated that the same is true for a right-hand door. As used herein, the terms left-hand door and right-hand door refer to the side of the door on which the hinges would be located (e.g., the left side of door 4 in FIG. 1), regardless of whether the door is in-swinging or out-swinging, when viewing the door from outside looking inward (e.g., from the body 27 looking inward toward the thumbturn 17). The terms clockwise and counter-clockwise as used hereinafter with respect to operating modes of the assembly 1 refer to the direction in which the ring is rotated, from the point of view of a user looking outward through the lock assembly (e.g., from the cutout 21 of the door 4 looking outward toward the body 27 of the lock assembly 1 as shown in FIG. 5A) to move the deadbolt 6 from its unlocked position to its locked position.

For example, in the illustrated embodiment, the lock assembly 1 is mounted on a left-hand in-swinging door 4 (FIG. 1). As shown in FIGS. 5A-8, the lock assembly 1 is operable in a counter-clockwise direction to lock the deadbolt 6. The lock assembly 1, if used on a right-hand door (FIGS. 9 and 10), would thus be operable in a clockwise direction wherein the ring 11 is rotated clockwise to move the deadbolt 6 from its unlocked position (FIG. 9) to its locked position (FIG. 10). It is understood, however, that the lock assembly may instead be operable in a clockwise direction on a left-hand door and in a counter-clockwise direction on a right-hand door.

Operation of the lock assembly 1 will now be particularly described with reference to FIGS. 5A-8. FIGS. 5A and 5B illustrate the actuator 61 at an angular, unlocked position corresponding to the unlocked position of the deadbolt 6 wherein the deadbolt is recessed into the door (e.g., as shown in FIG. 1). The ring 11 is in what is referred to herein as an initial or set position in which rotation of the ring in the direction corresponding to the operating mode of the lock assembly (e.g., counter-clockwise in the embodiment illustrated in FIGS. 5A-8) results in movement generally toward the actuator 61. In the illustrated embodiment, the actuator contact mechanism 65 (and in particular the pin 67 in FIGS. 5A and 5B) abuts against the actuator 61 (and in particular the actuator arm 62) in the initial position of the ring 11 and the unlocked position of the actuator. However, it is contemplated that the actuator contact mechanism 65 may be spaced from (e.g., out of contact with) the actuator 61 in the initial position of the ring 11 and unlocked position of the actuator, as long as rotation of the ring from its initial position in the direction of operation of the assembly results in rotation of the actuator contact mechanism 65 toward and into contact with the actuator 61.

For keyless operation of the lock assembly 1 to lock the deadbolt 6, the ring 11 is manually gripped and rotated from its initial position in the direction of operation (e.g., counter-clockwise in FIGS. 5A-8). The actuator contact mechanism 65 rotates conjointly with the ring 11 into contact with the actuator 61 whereby further rotation of the ring rotates the actuator from its unlocked position toward its locked position. For example, in the illustrated embodiment the head 67*a* of the actuator contact mechanism pin 67 contacts the actuator arm 62 to rotate the actuator 61 about its rotation axis L2 toward the locked position of the actuator as illustrated in FIG. 7. The operative connection of the actuator 61 with the deadbolt 6, e.g., via the operative connection between the actuator and the torque blade 23 and between the torque blade and the deadbolt backset 19, causes the deadbolt 6 to move toward its locked position upon rotation of the actuator toward the locked position of the actuator.

Rotation of the ring 11 continues until the deadbolt 6 is fully extended to its locked position. In the illustrated embodiment, the ring 11 is rotated to what is referred to herein as a rotated position of the ring in which the actuator 61 is rotated fully to its angular, locked position corresponding to the locked position of the deadbolt 6. Rotation of the ring 11 in the illustrated embodiment is limited by contact between the actuator contact mechanism 65 and the ends 69L, 69R of the arcuate flange 33 extending inward from the body 27 to indicate rotation of the ring to its rotated position in which the deadbolt 6 is in its locked position.

Because the ring 11 is operatively connected to the biasing member 71 via the connection between the actuator contact mechanism pin 67 and the annular plate 73 of the biasing member, rotation of the ring 11 from its initial position to its rotated position conjointly rotates the annular plate 73 of the biasing member 71 relative to the springs 72L, 72R. The tab 81 extending outward from the annular plate 73 between the upper ends of the springs 72L, 72R compresses one of the springs in the direction of movement of the tab. For example, as shown in FIG. 7, counter-clockwise rotation of the tab 81 compresses the spring 72L between the tab and the lower pair of spring seats 77 formed in the annular channel 74 of the body 27. The other spring 72R is independent of the compressed spring 72L and is thus unaffected by the counter-clockwise rotation of the annular plate 73.

Figure 8:
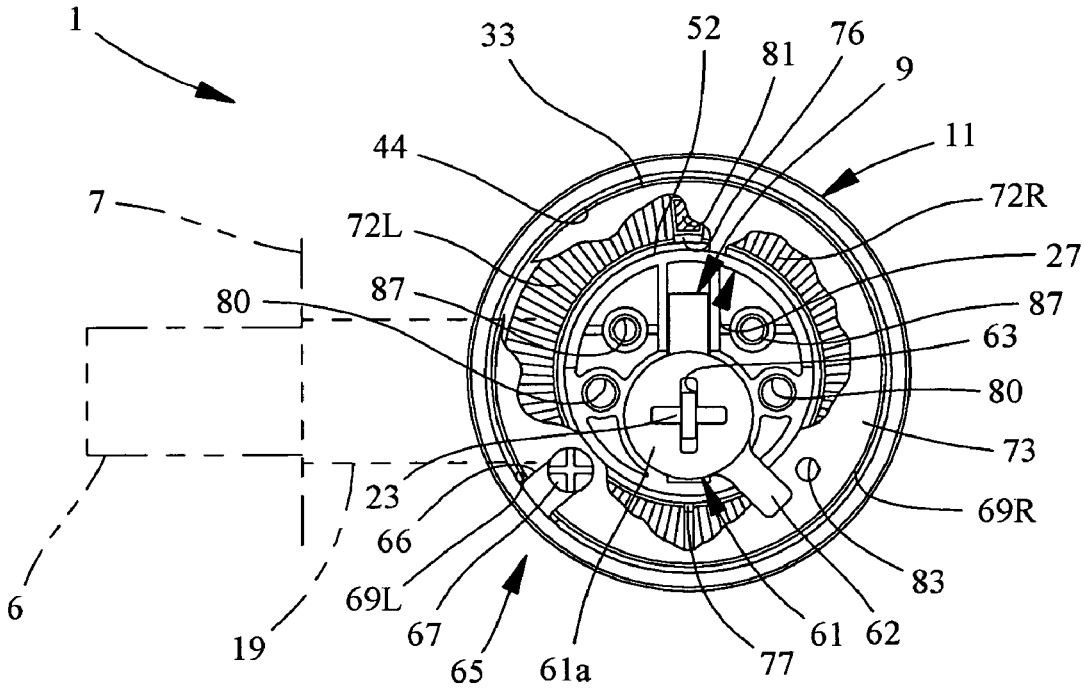
FIG. 8 is an end view similar to FIG. 5A with the ring returned to its initial position while the actuator remains in its locked position.

Once the ring 11 is manually rotated to its rotated position to lock the deadbolt 6, the ring 11 is released. The bias of the compressed spring 72L acts against the tab 81 of the annular plate to urge rotation of the annular plate 73 (and hence the ring 11 via its operative connection to the annular plate), in the direction opposite (e.g., clockwise in the embodiment of FIGS. 5A-8) the direction of operation of the ring. The ring 11 thus rotates back toward and is returned to its initial or set position as illustrated in FIG. 8. The actuator contact mechanism 65 of the ring 11 is conjointly rotated with the ring out of contact with and away from the actuator 61. The actuator remains in its locked position until a key or the thumbturn 17 is used to rotate the deadbolt 6 to the unlocked position of the deadbolt. That is, rotation of the key or the thumbturn 17 rotates the torque blade 23 to thereby act on the deadbolt backset 19 to move the deadbolt 6 to its unlocked position.

It will be seen that by biasing the ring 11 to return to its initial position following rotation of the ring to lock the deadbolt 6 (and subsequent release of the ring), the angular path of movement of the torque blade 23 along with the actuator 61 as they rotate from the locked position to the unlocked position upon unlocking the deadbolt is substantially free from structure that would otherwise contact the actuator 61 along its angular path of movement. That is, the actuator 61 does not contact any ring structure, and in particular any actuator contact mechanism structure, as it is returned along its angular path of movement from the locked position of the actuator to its unlocked position.

The stabilizing bridge 29 provides increased support for the mounting screws 25 that extend therethrough, and in particular the stabilizing bridge 29 inhibits rotation of the mounting screws 25 transverse to their longitudinal axes. For example, when the ring 11 rotates to lock the deadbolt 6, it creates a small torsion force in the lock assembly 1. In a typical deadbolt apparatus, this torsion is resisted by mounting screws where the screws pass through a deadbolt backset. But if the torsion force is sufficiently large, such as may occur if a wrench is applied to a ring of a reversible keyless deadbolt door lock assembly to twist it from the lock assembly, the backset may not provide enough support to the screws. The screws may instead rotate and break between the lock assembly and backset, allowing unwanted access. The stabilizing bridge 29 of this invention further inhibits torquing of the screws 25 to reduce the risk of damage to the screws. It is contemplated that the stabilizing bridge 29 could also be used with a conventional key operated deadbolt lock assembly or a conventional latch-type door lock to provide the same additional benefits described above.

Figure 9:
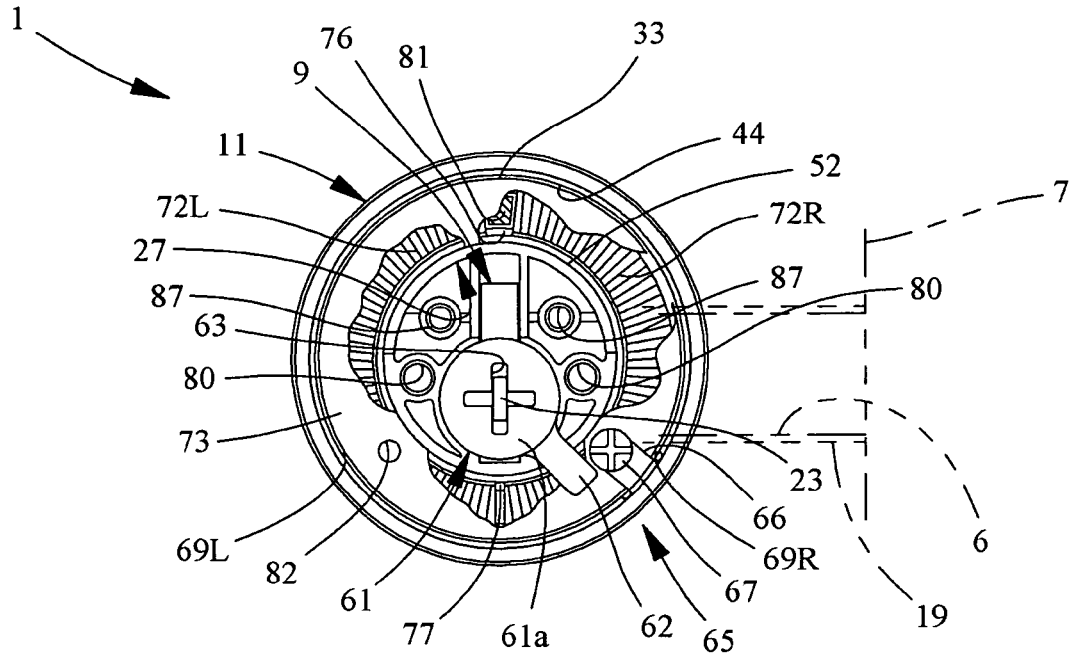
FIG. 9 is an end view similar to FIG. 5A with the lock assembly in a clockwise operating mode, the ring being in an initial position and the actuator being in an unlocked position.
Figure 10:
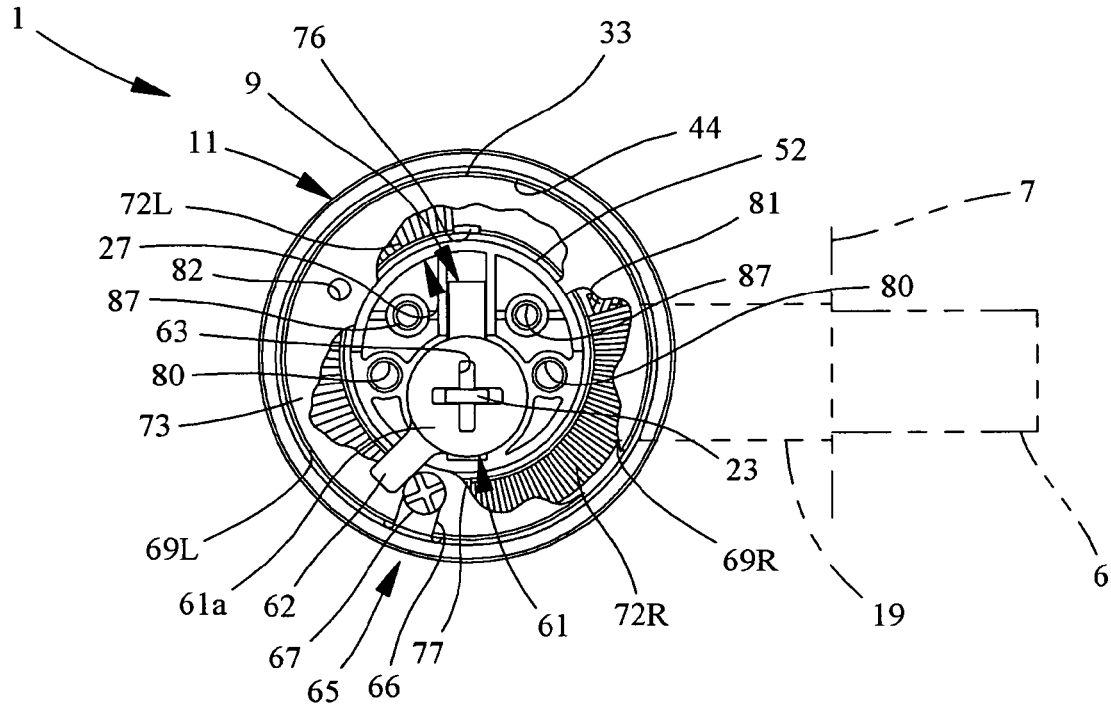
FIG. 10 is an end view similar to FIG. 8 with the ring in a rotated position and the actuator in a locked position.

To reverse the mode of operation of the lock assembly 1 of the illustrated embodiment, e.g., from the counter-clockwise mode of operation illustrated in FIGS. 5A-8 to a clockwise mode of operation as shown in FIGS. 9 and 10, the assembly must be removed from the door 4 and separated from the thumbturn 17 and deadbolt backset 19. When in the initial position (FIG. 5A) of the ring 11 and the unlocked position of the actuator 61 (and hence the deadbolt 6), the actuator contact mechanism pin 67 (which is accessible through the semi-circular access opening 42 in the lower half of the locator 31) is unthreaded from the bore 66*a* (FIG. 3) of the actuator contact mechanism finger 66 and removed from the annular plate 73 of the biasing member 71. With the pin 67 removed, the ring 11 is rotated (counter-clockwise in FIG. 9) relative to the locator 31, biasing member 71, actuator 61, and body 27 until the threaded bore 66*a* in the actuator contact mechanism 65 is aligned with the other opening 83 of the biasing member annular plate 73. For example, in the illustrated embodiment the ring is rotated through an angle of about 90 degrees.

The pin 67 is reconnected to the actuator contact mechanism 65 and biasing member annular plate 73 to define a new initial or set position of the ring 11 corresponding to a different mode of operation of the ring. The actuator 61, along with the torque blade 23 operatively connected thereto, is rotated in the same direction as the ring 11 (in the illustrated embodiment, through an angle of about 90 degrees) relative to the locator 31, biasing member 71, body 27, and ring such that it also has a new angular, unlocked position and a new angular locked position (the torque blade is now generally vertical (FIG. 9)). For example, as illustrated in FIG. 9, the lock assembly 1 is now operable in a clockwise mode of operation in which rotation of the ring 11 from the initial position illustrated in FIG. 9 in a clockwise direction results in conjoint movement of the actuator contact mechanism 65 toward and into contact with the actuator 61 to rotate the actuator in a clockwise direction from its unlocked position (FIG. 9) to a locked position (FIG. 10) in which the deadbolt 6 is moved to its locked position. Instead of the spring 72L being compressed, the spring 72R is now compressed and urges the ring 11 to rotate counter-clockwise from its rotated position back to its initial position and away from the actuator 61 while the actuator remains in its locked position until a key or thumbturn 17 is used to unlock the deadbolt 6.

Thus, it will be seen that the lock assembly 1 is operable in both the clockwise operating mode and the counter-clockwise operating mode without having to remove or otherwise adjust various components of the lock assembly. For example, in a particularly suitable embodiment such as that illustrated in FIGS. 1-10, the lock assembly is operable in the clockwise and counter-clockwise operating modes without removing or otherwise adjusting the biasing member 71, among other components, of the lock assembly 1.

Figure 11A:
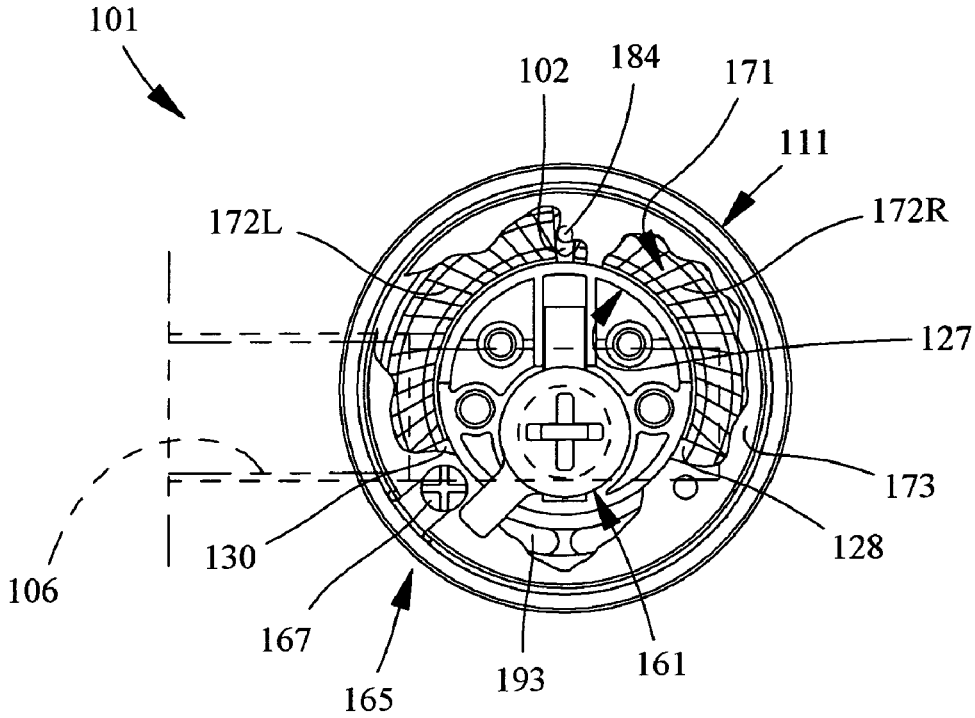
FIG. 11A is an end view of a keyless deadbolt door lock assembly according to a second embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a portion of the lock assembly broken away to show internal construction of the lock assembly.
Figure 11B:
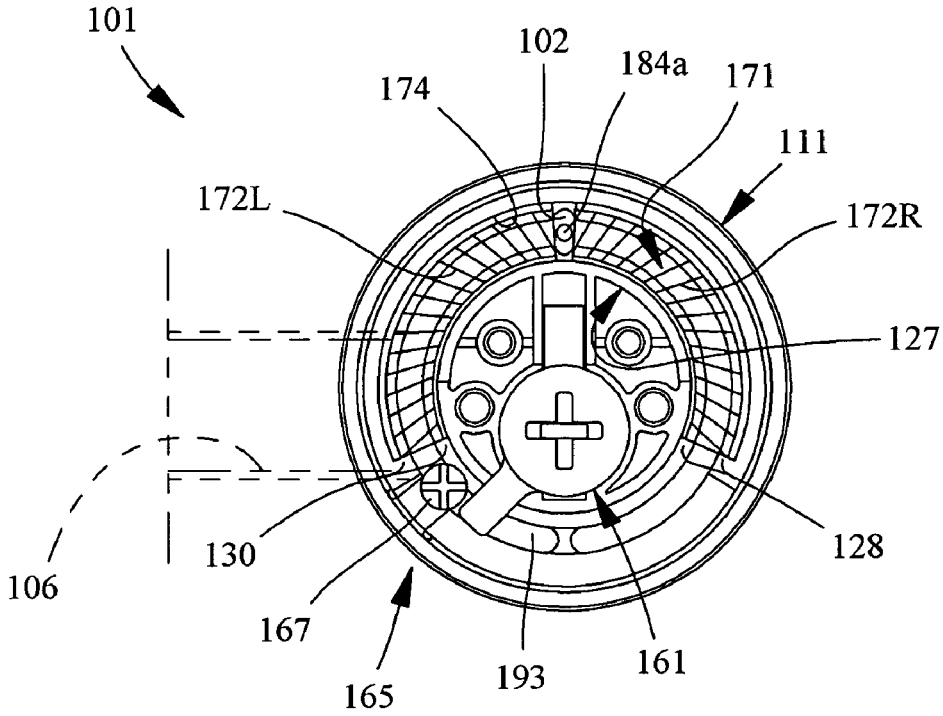
FIG. 11B is an end view similar to FIG. 11A with components of the lock assembly omitted to show internal components of the lock assembly.
Figure 12:
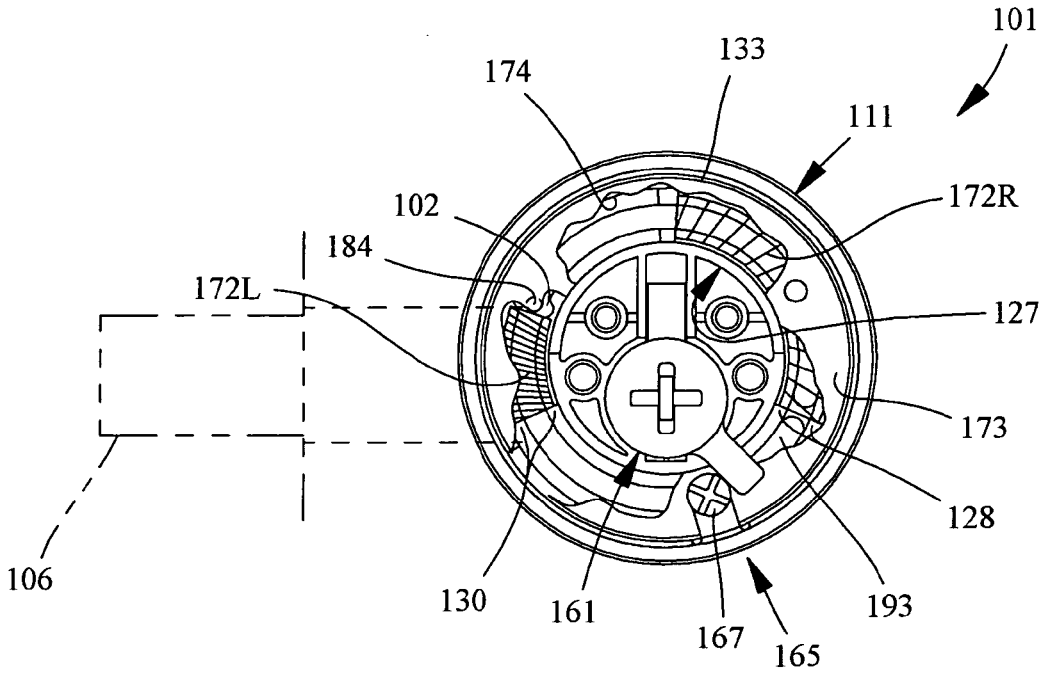
FIG. 12 is an end view similar to FIG. 11A with the ring illustrated in a rotated position and the actuator in a locked position corresponding to a locked position of the deadbolt.

FIGS. 11A-12 illustrate a keyless deadbolt lock assembly according to a second embodiment. The lock assembly is indicated generally at 101 in FIGS. 11A-12. The illustrated lock assembly 101 is configured for operation on a left-hand door (not shown, but substantially similar to the manner in which the lock assembly 1 is mounted on the door 4 shown in FIG. 1). The lock assembly 101 is substantially similar to the lock assembly 1 of the first embodiment shown in FIGS. 1-10 but with the general exception of the biasing member, indicated generally at 171. The biasing member of this second embodiment comprises a pair of compression springs 172L and 172R, which are mounted on an annular spring carrier 193, and a washer-shaped annular plate 173. The spring carrier 193 has a break generally at its lower position (in the orientation shown in FIGS. 11A and 11B) for mounting the springs 172L, 172R thereon. The spring carrier 193 also has an integrally formed abutment member 102 sized larger than the cross-section of the springs 172L, 172R such that the upper ends of the springs 172L, 172R abut against the abutment member in spaced relationship with each other.

The biasing member 171 seats within a circumferential channel 174 (FIG. 11B) of lock assembly body 127. The body 127 has spring seats 128, 130 disposed in the channel 174 in angular spaced relationship with each other; the lower ends of the springs 172L, 172R abutting against the respective spring seats 128, 130. The annular plate 173 of the biasing member 171 is operatively connected to the spring carrier 193 for conjoint rotation relative to the body 127. As an example, in the illustrated embodiment the annular plate 173 has a pin 184 near its top position (FIG. 11A) extending outward/forward therefrom for seating within an opening 184*a* (FIG. 11B) in the abutment member 102 of the spring carrier 193. This permits easy removal of the annular plate 173 from the springs 172L, 172R and spring carrier 193. However, it is contemplated that the annular plate 173 may be affixed to the spring carrier 193 without departing from the scope of this invention. The biasing member 171 is operatively connected to ring 111 by actuator contact mechanism 165 (and specifically by actuator contact mechanism pin 167) in the same manner as in the first embodiment of FIGS. 1-10.

Operation of the lock assembly 101 is also substantially the same as the lock assembly 1 of the first embodiment. In the counter-clockwise operating mode illustrated in FIGS. 11A-12, as ring 111 is rotated counter-clockwise from its initial position (FIGS. 11A and 11B) to its rotated position (FIG. 12), the actuator contact mechanism 165 contacts actuator 161 and moves the actuator from its unlocked position (FIGS. 11A and 11B) to its locked position (FIG. 12). The operative connection between the ring 111 and the spring carrier 193, e.g., via the connection between the actuator contact mechanism 165 and the biasing member annular plate 173, and between the biasing member annular plate and the spring carrier 193, causes the spring carrier to rotate counter-clockwise with the ring 111.

The spring 172L becomes compressed between the abutment member 102 and the spring seat 130. Following rotation of the ring 111 to its rotated position to lock deadbolt 106 (FIG. 12), the ring is released and the spring bias of the compressed spring 172L returns the ring 111 (and actuator contact mechanism 165) to its initial position while the actuator 161 remains in its locked position until a key or a thumbturn is used to unlock the deadbolt 106.

The mode of operation of the lock assembly 101 of this second embodiment is reversed, e.g., from the counter-clockwise mode of operation illustrated in FIGS. 11A-12 to a clockwise mode of operation (not shown but similar to the clockwise mode of operation of the first embodiment) in the same manner as the lock assembly 1 of the first embodiment.

FIGS. 13-16 illustrate a keyless deadbolt lock assembly, generally indicated at 201, according to a third embodiment of the invention. The lock assembly 201 of this third embodiment is substantially similar to the lock assembly 1 of the first embodiment of FIGS. 1-10 with the exception of biasing member 271 and ring 211 (and more particularly actuator contact mechanism 265 of the ring). The actuator contact mechanism 265 of the ring 211 of this embodiment comprises a generally T-shaped finger 266 extending radially inward from the ring. The finger 266 has a pair of openings 288, 289 spaced laterally apart from each other, with each opening being internally threaded for threadably (e.g., releasably) receiving pin 267.

The biasing member 271 of this third embodiment comprises a single coiled extension spring 278 extending arcuately within an upper angular segment of channel 274 of body 227. Ends 278*a*, 278*b* of the spring 278 connect to the body 227 at respective connecting pins 291, 292 connected to the body 227 and disposed with the channel 274 in angularly spaced relationship with each other. A spring actuating tab 290 extends radially inward of the ring 211 generally at the top of ring, e.g., diametrically opposed to the T-shaped finger 266. Upon assembly, the tab 290 is disposed between the coils of the spring 278 generally at the mid-length of the spring as seen best in FIG. 13. In the illustrated embodiment, the tab 290 is formed integrally with the ring 211. However, it is understood that the tab 290 may be formed separate from the ring 211 and affixed or releasably connected thereto without departing from the scope of the invention.

Figure 13:
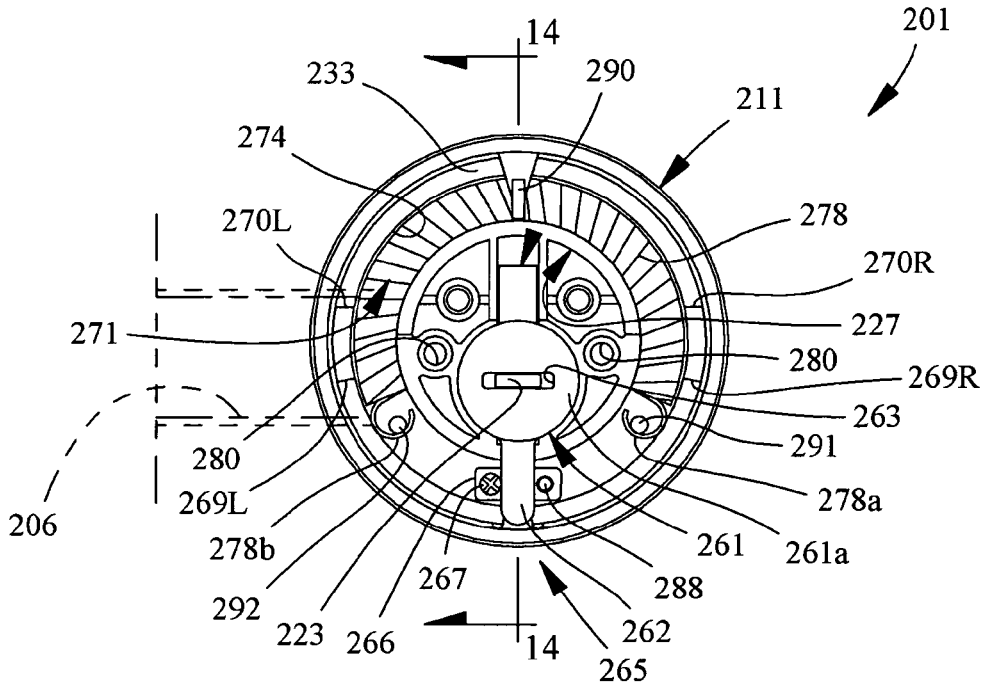
FIG. 13 is an end view of a keyless deadbolt door lock assembly according to a third embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a locator of the lock assembly omitted to show internal construction of the lock assembly.
Figure 14:
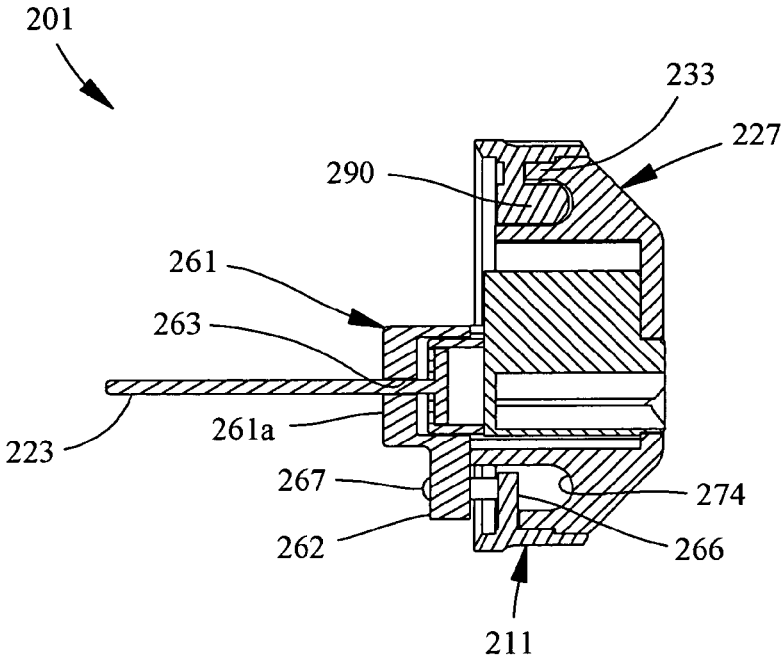
FIG. 14 is a section taken in the plane of line 14-14 of FIG. 13.
Figure 15:
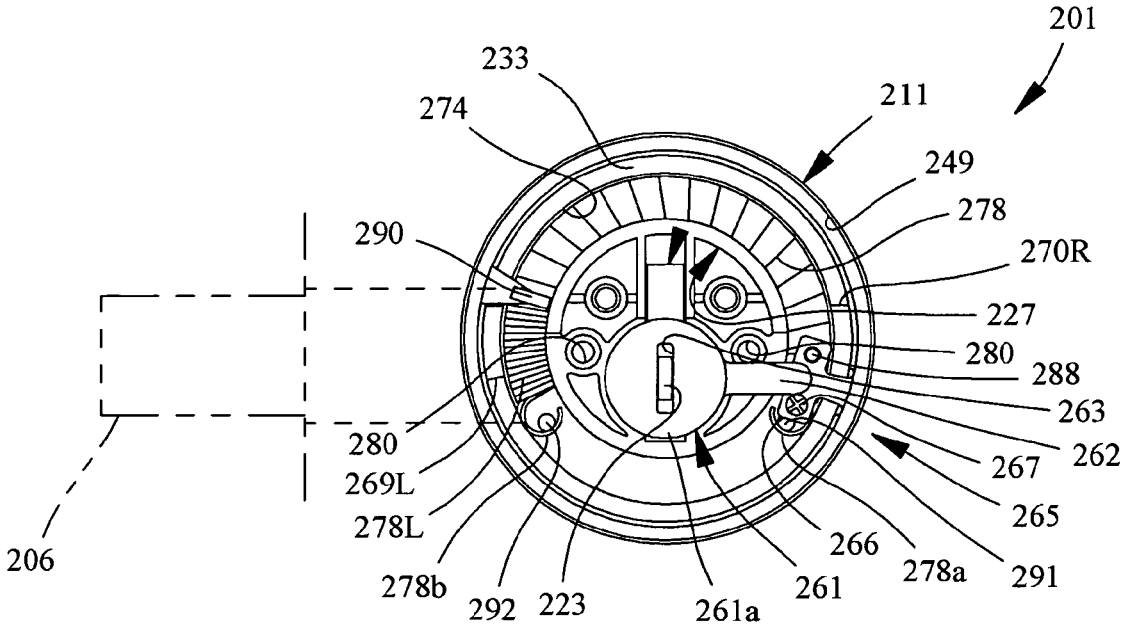
FIG. 15 is an end view similar to FIG. 13 with the ring illustrated in a rotated position and the actuator illustrated in a locked position corresponding to the locked position of the deadbolt.

FIGS. 13-15 illustrate the operation of the lock assembly 201 of this embodiment. In FIG. 13, actuator 261 is in its unlocked position corresponding to the unlocked position of deadbolt 206 (this is substantially the same as the unlocked position of deadbolt 6 of the first embodiment). The ring 211 is at an angular position corresponding to its initial or set position. The lock assembly 201 is operable in its counter-clockwise mode of operation in FIG. 13 whereby rotation of the ring 211 in the counter-clockwise direction toward its rotated position (FIG. 15) moves the actuator contact mechanism 265 (and more particularly the pin 267 extending from the T-shaped finger 266 in the illustrated embodiment) into contact with the actuator 261 to move the actuator to its locked position (FIG. 15) corresponding to the locked position of the deadbolt 206. In this operation, as in the previous embodiments, finger 266 of the actuator contact mechanism 265 moves toward end 269R of arcuate flange 233 of the body 227.

FIG. 15 illustrates the lock assembly 201 with the ring 211 rotated to its rotated position such that actuator 261 is in its locked position. The spring actuator tab 290, which is connected to the ring 211 for conjoint rotation therewith relative to the body 227, rotates toward edge 270L of arcuate flange 233 of the body and compresses the spring 278 on one side of the channel 274 while extending the spring on the opposite side of the channel. Extension of the spring 278 creates a spring bias that pulls the tab 290, and hence the ring 211, such that upon release of the ring following locking of the deadbolt 206, the spring bias returns the ring to its initial position while the actuator 261 remains in its locked position (this position is not shown but is similar to the lock assembly of the first embodiment in the condition illustrated in FIG. 8).

During locking operation, the actuator 261 moves with the ring 211, and actuator arm 262 contacts one of two mounting screws (not shown) passing though openings 280 in the body 227. Just prior to fully locking the deadbolt 206, the actuator arm 262 pivots about the mounting screw and causes the actuator 261 to slide slightly downward relative to torque blade 223. A groove 263 in cup-shaped member 261*a* of the actuator 261 accommodates this actuator movement (in this embodiment the groove 263 is not cross-shaped, but is a single slot).

Figure 16:
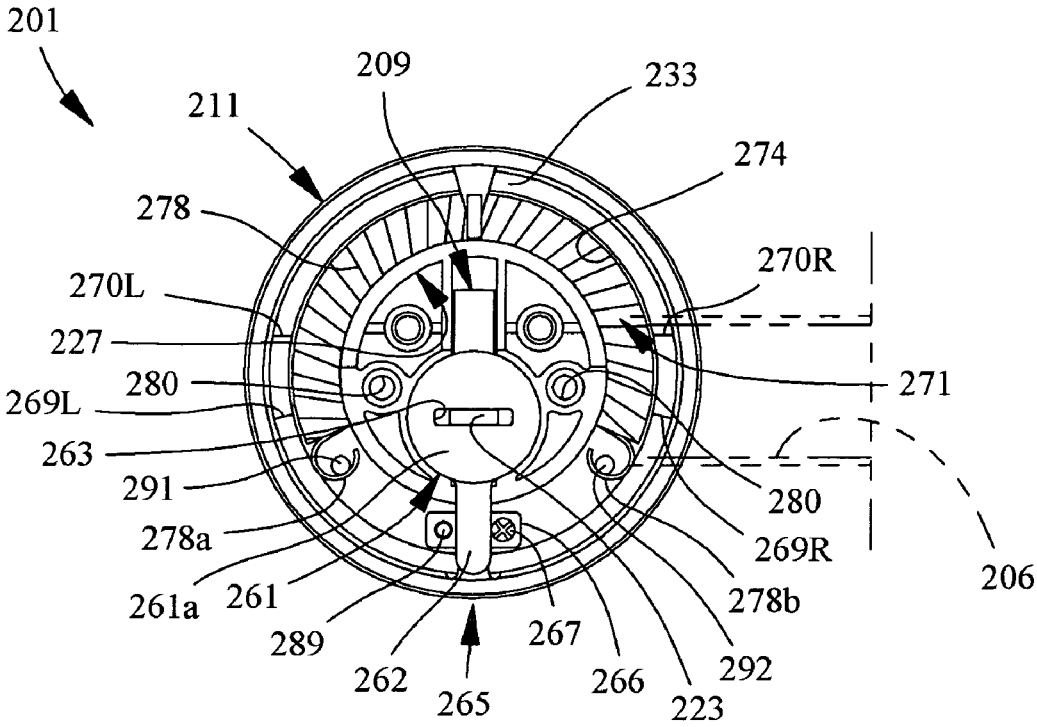
FIG. 16 is an end view of the lock assembly of FIG. 13 configured for clockwise operation, with the ring in an initial position and the actuator in an unlocked position corresponding to the unlocked position of the deadbolt.

With reference to FIG. 16, the lock assembly 201 is operable in its clockwise operating mode (i.e., clockwise rotation of the ring to lock the deadbolt as viewed in FIG. 16), by unthreading the pin 267 from the T-shaped finger 266 of the actuator contact mechanism 265. With the ring 211 at its initial position and the actuator 261 in its unlocked position, the pin 267 is threadably connected to the T-shaped finger 266 at the opposite opening 288 in the finger. Accordingly, rotation of the ring 211 in the clockwise direction now moves the actuator contact mechanism 265 into contact with the actuator 261 for moving the actuator (and hence the deadbolt 206) from its unlocked to its locked position. Ring rotation also moves actuator contact mechanism 265 toward edge 269L of flange 233. Spring actuator tab 290 rotates toward edge 270R of flange 233 and compresses spring 278 on the right side of channel 274 and extends it on the left side (not shown).

It is envisioned that the lock assembly 201 could be modified (not shown) so that the coiled extension spring 278 of the biasing member 271 would extend arcuately within a lower angular segment of channel 274 of body 227. Ends 278*a*, 278*b* of the spring 278 would again connect to the body 227 at respective connecting pins 291, 292 connected to the body 227 and disposed with the channel 274 in angularly spaced relationship with each other. Here, the spring actuator tab 290 could be formed as part of the actuator contact mechanism 265 and would extend forward from the ring finger 266. Upon assembly, the actuator tab 290 would be disposed between the coils of the spring 278 generally at the mid-length of the spring, as was previously described. It is further envisioned that this modification could apply to the coil springs of each biasing member described and illustrated herein.

Figure 17:
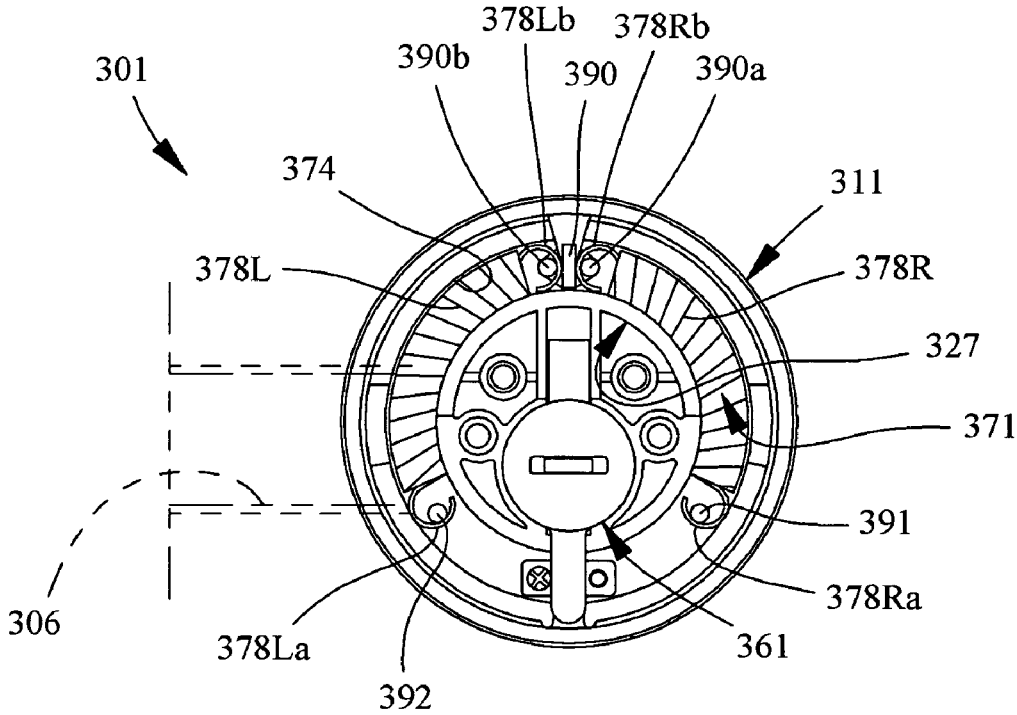
FIG. 17 is an end view of a keyless deadbolt door lock assembly according to a fourth embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a locator of the lock assembly omitted to show internal construction of the lock assembly.

FIG. 17 illustrates a fourth embodiment of a keyless deadbolt lock assembly, generally indicated at 301, that is substantially identical to the lock assembly 201 of FIGS. 13-16 with the exception of the biasing member 371. In this particular embodiment, the biasing member 371 comprises a pair of coiled tension springs 378L, 378R disposed within channel 374 of assembly body 327. A first end 378La of spring 378L connects to body 327 at body pin 392, and a first end 378Ra of spring 378R connects to the body at body pin 391. Also in this embodiment, spring actuator tab 390 comprises a pair of laterally spaced connection pins 390*a*, 390*b*. Second ends 378Lb and 378Rb of the tension springs 378L, 378R are connected to the tab 390 by pins 390*b*, 390*a*, respectively.

When ring 311 is rotated counter-clockwise (as viewed in FIG. 17) in the counter-clockwise operating mode of the assembly 301 to move deadbolt 306 to its locked position (not shown, but done in substantially the same manner as in the third embodiment of FIGS. 13-16),) the spring actuator tab 390 rotates conjointly with the ring 311 to tension spring 378R between the actuator tab pin 390*a* and the body pin 391. Spring 378L is likewise loosely compressed between the tab 390 and the body pin 392.

Upon releasing the ring 311, i.e., once actuator 361 (and hence the deadbolt 306) is moved to its locked position, the tension in the spring 378R urges the ring to rotate clockwise back to its initial position.

Adjusting assembly 301 for operation on a right-hand door is done in substantially the same manner as was described for the third embodiment shown in FIGS. 13-16.

Figure 18:
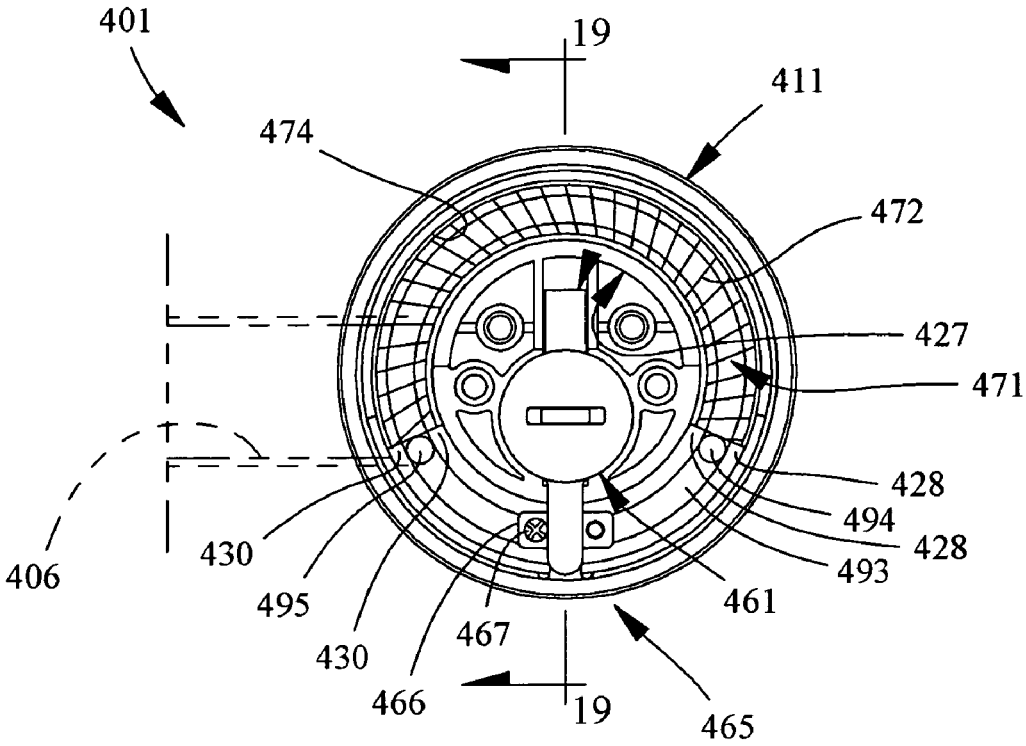
FIG. 18 is an end view of a keyless deadbolt door lock assembly according to a fifth embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a locator of the lock assembly omitted to show internal construction of the lock assembly.
Figure 19:
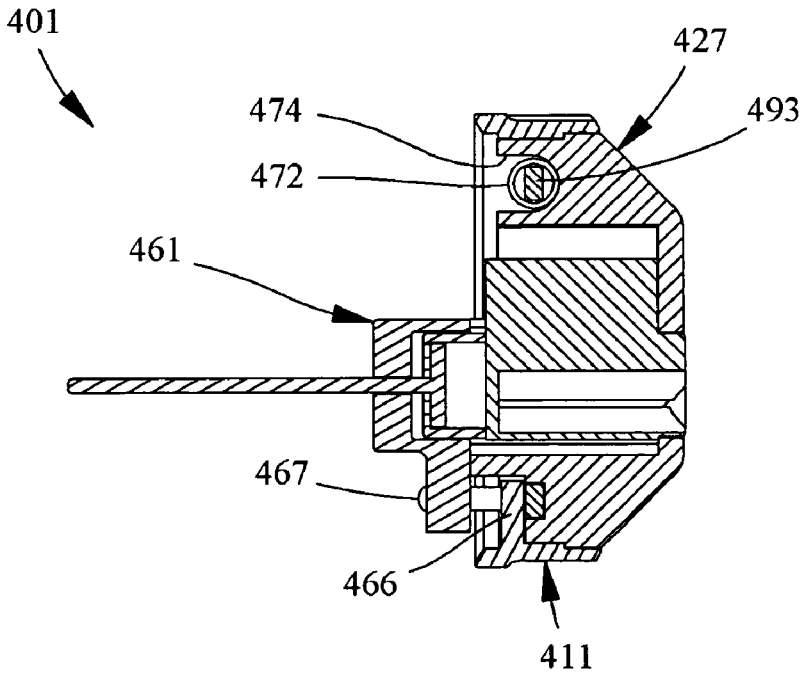
FIG. 19 is a cross-section taken in the plane of line 19-19 of FIG. 18.
Figure 20:
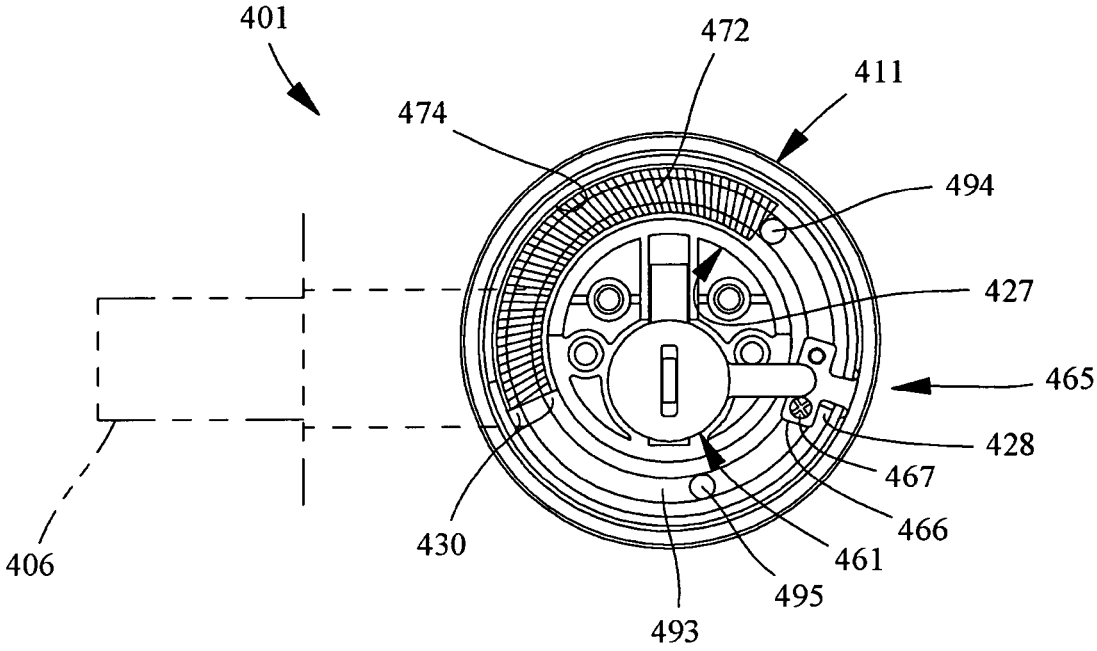
FIG. 20 is an end view similar to FIG. 18 with the ring illustrated in a rotated position and the actuator illustrated in a locked position corresponding to the locked position of the deadbolt.

In a fifth embodiment, illustrated in FIGS. 18-20, a lock assembly (generally indicated at 401) is substantially similar to the lock assembly 201 of the third embodiment (FIGS. 13-16), but having a biasing member 471 that instead comprises a coiled compression spring 472 mounted on a generally annular spring carrier 493. The spring carrier 493 has a break (not visible, but is generally under actuator contact mechanism 465) near its bottom (in the orientation shown in FIG. 18) for mounting the spring 472 on the carrier. The spring carrier 493 also comprises a pair of pins 494, 495 (FIGS. 18 and 20) extending therefrom in angularly spaced relationship with each other and generally in contact with the respective ends of the spring 472. In the illustrated embodiment, the pins 494, 495 are formed separately from the carrier 493 and connected to the carrier after the spring 472 is mounted thereon. However, it is contemplated that the pins 494, 495 may be formed integrally with the spring carrier 493 without departing from the scope of this invention.

Pairs of shoulders 428, 430 are formed in the channel 474 of body 427 to provide fixed stops against which the ends of the spring 472 seat. Threaded pin 467 of the actuator contact mechanism 465 extends through finger 466 of the contact mechanism so that its tip seats in a corresponding opening in the spring carrier 493, generally adjacent the break in the carrier, to operatively connect the biasing member 471 (and in particular the spring carrier) with ring 411 via the actuator contact mechanism (the pin 467 connects to the carrier 493 in substantially the same manner that the pin 67 connects to the annular plate 73 in the first embodiment of FIGS. 1-10).

In the counter-clockwise mode of operation of the lock assembly 401, ring 411 is rotated counter-clockwise (as viewed in FIG. 18) to move actuator 461 and lock deadbolt 406 in substantially the same manner as described previously for the third embodiment of FIGS. 13-16. Rotation of the ring 411 conjointly rotates the spring carrier 493 relative to the body 427 and spring 472. As illustrated in FIG. 20, upon such rotation the carrier pin 494 compresses the spring 472 between the pin and the shoulders 430. The spring compression provides the bias that urges the ring 411 to return to its initial position following release of the ring once the deadbolt 406 is locked.

For operation in the clockwise mode of operation of the lock assembly 401 (not shown), the threaded pin 467 is removed from the spring carrier 493 and the contact actuator mechanism 465 and reconnected to the actuator contact mechanism at opening 480 therein in the same manner as in the third embodiment of FIGS. 13-16. The pin 467 again extends through the actuator contact mechanism 465 and seats within a corresponding opening (not shown) in the spring carrier 493 of the biasing member 471 to operatively reconnect the ring 411 to the biasing member.

Figure 21:
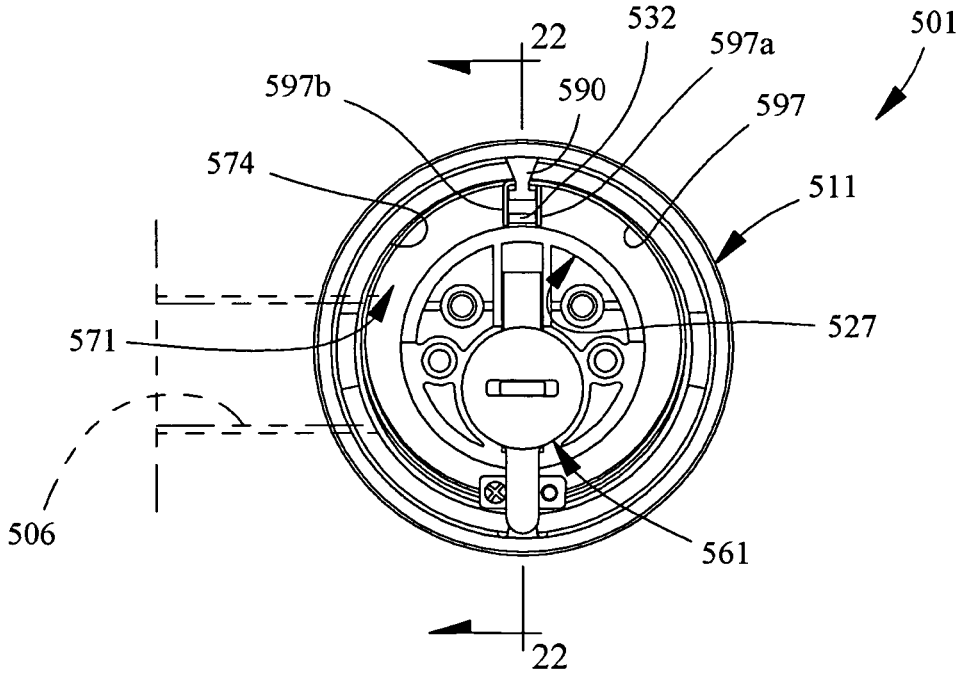
FIG. 21 is an end view a keyless deadbolt door lock assembly according to a sixth embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a locator of the lock assembly omitted to show internal construction of the lock assembly.
Figure 22:
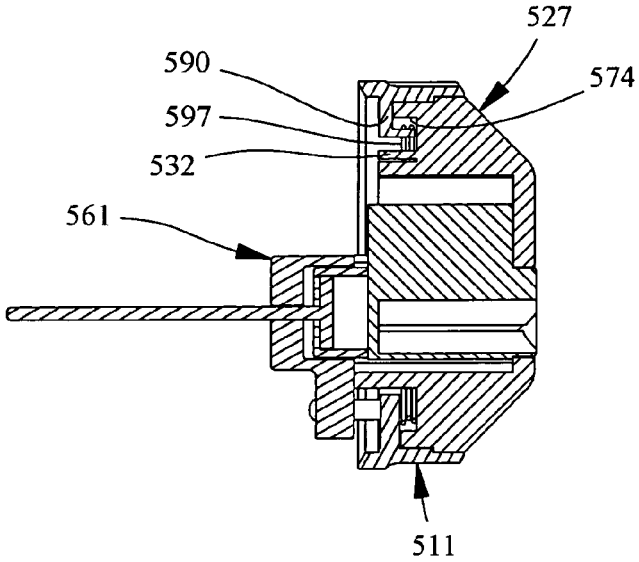
FIG. 22 is a cross-section taken in the plane of line 22-22 of FIG. 21.
Figure 23:
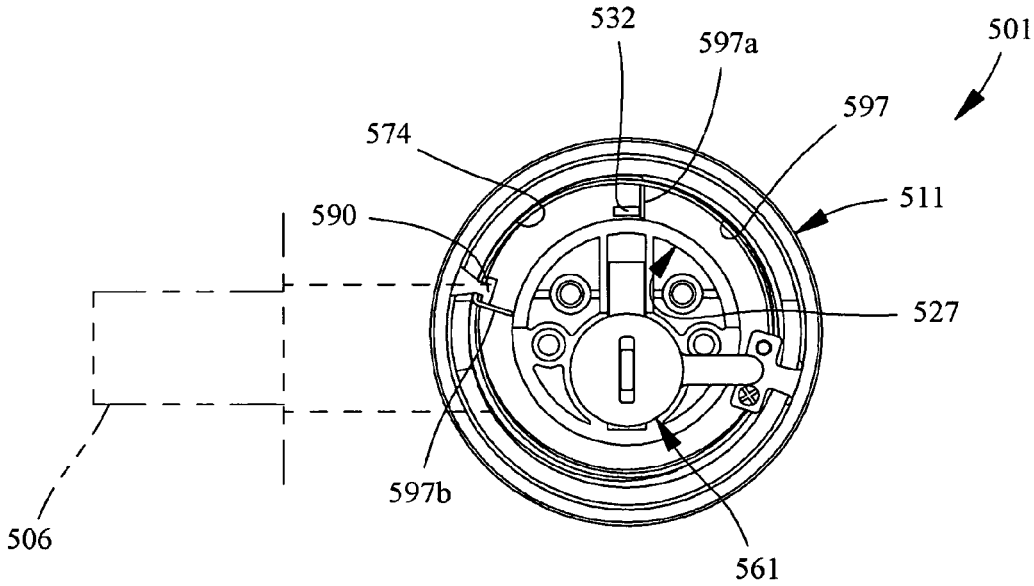
FIG. 23 is an end view similar to FIG. 21 with the ring illustrated in a rotated position and the actuator illustrated in a locked position corresponding to the locked position of the deadbolt.

FIGS. 21-23 illustrate a sixth embodiment in which a lock assembly, generally indicated at 501, is substantially the same as the lock assembly 201 illustrated in FIGS. 13-16 and described previously. However, in this sixth embodiment, the biasing member, generally indicated at 571, comprises a torsion spring 597 disposed within channel 574 of assembly body 527. Opposed ends 597*a*, 597*b* of the spring 597 are each bent radially inward as shown in FIG. 21. In particular, the spring 597 is positioned within the channel 574 of the body 527 with the ends 597*a*, 597*b* extending circumferentially past what would otherwise be an end-to-end relationship, i.e., the spring 597 overlaps itself at its ends, with the bent ends 597*a*, 597*b* of the spring being circumferentially spaced from each other.

The bent ends 597*a*, 597*b* of the spring 597 are held in spaced relationship by a stop 532 formed in the channel 574 of the body 527. A tab 590 also extends radially inward from ring 511 to a position between the bent ends 597*a*, 597*b* of the spring 597 in generally opposed relationship with the stop 532 when in the initial position of the ring 511, as illustrated in FIG. 21. The bias of the spring 597 generally urges the bent ends 597*a*, 597*b* toward each other into abutting contact with the tab 590 and/or stop 532.

Operation of the lock assembly 501 in its counter-clockwise operating mode to lock deadbolt 506 is substantially the same as described for the third embodiment of FIGS. 13-16. As illustrated in FIG. 23, upon counter-clockwise rotation of the ring 511 to lock the deadbolt 506, the radially inward extending tab 590 rotates conjointly with the ring 511 and pushes against the bent end 597*b* of the spring 597 to torque the spring in the counter-clockwise direction. The opposite bent end 597*a* of the spring is held against movement by the stop 532. Once the ring 511 has been rotated to its rotated position to lock actuator 561 (and the deadbolt 506), the ring is released and the torsion in the spring 597 urges the ring 511 to return to its initial position.

Operation of the lock assembly 501 in its clockwise mode of operation is effected substantially as described previously for the third embodiment of FIGS. 13-16.

FIGS. 24-28 illustrate a keyless deadbolt lock assembly (generally indicated at 601) according to a seventh embodiment of the invention. In this embodiment, biasing member 671 comprises a pair of coiled compression springs 672L, 672R mounted on a generally annular spring carrier 693 and disposed within channel 674 of lock assembly body 627. The spring carrier 693 has a break formed therein to allow mounting of the springs 672L, 672R on the carrier, and also has a circumferentially extending recess 610 (FIG. 24) formed in a portion of the outer circumference of the spring carrier. A spring seat 602 is formed integrally with the spring carrier 693 and separates the upper ends (in the orientation illustrated in FIG. 24) of the springs 672L, 672R. Lower ends of the springs 672L, 672R abut against respective pairs of shoulders 630, 628 formed in the channel 674 of the lock assembly body 627.

Figure 25:
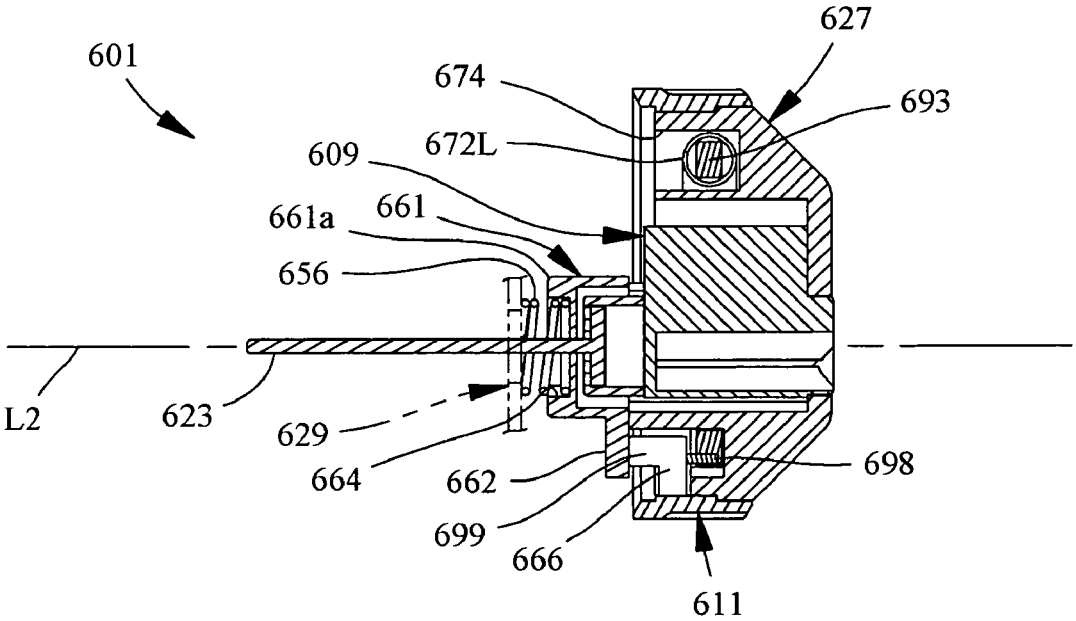
FIG. 25 is a cross-section taken in the plane of line 25-25 of FIG. 24.

Rotatable ring 611 of the illustrated seventh embodiment has an actuator contact mechanism 665 in the form of a finger 666 that extends radially inward from the inner surface of the ring 611. As best seen in FIG. 25, a projection member 699 extends inward from the finger 666 for contacting actuator 661 as will become apparent. The finger 666 also has a spring actuating member 698 extending outward from the finger generally to within recess 610 formed in the spring carrier 693 to operatively connect the ring 611 with the biasing member 671.

Figure 27:
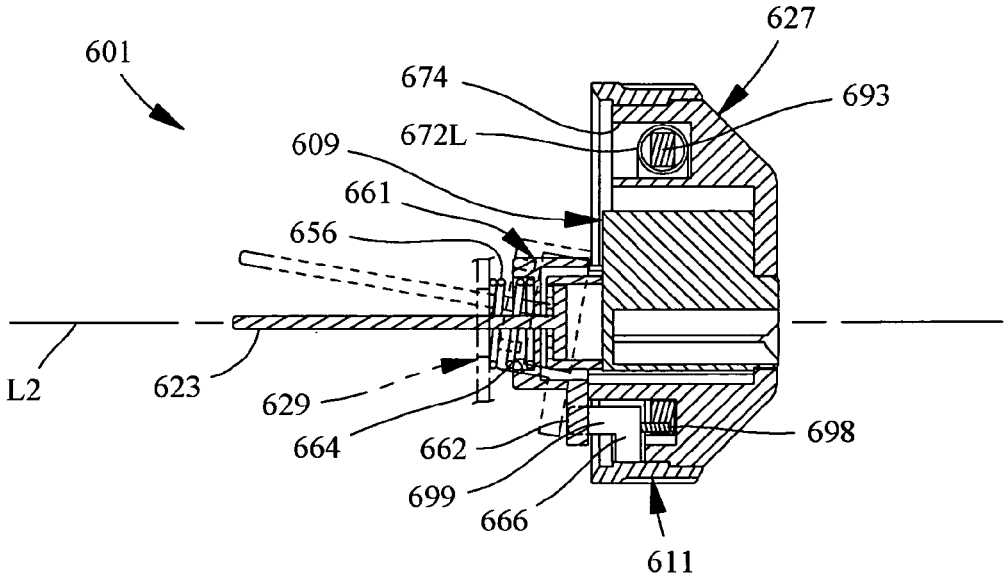
FIG. 27 is a cross-section similar to FIG. 25 illustrating movement of a torque blade to configure the lock assembly between its clockwise operating mode and counter-clockwise operating mode.

The lock assembly 601 of this seventh embodiment is particularly configured to permit operation of the lock assembly in its counter-clockwise and clockwise modes of operation without having to remove any components of the lock assembly. In particular, with reference to FIG. 25, inward facing surface 661*a* of the actuator 661 has a spring seat 664 formed therein for receiving an actuator spring 656. The actuator spring 656 is disposed between the actuator 661 and locator stabilizing bridge 629 to retain the spring in position within the spring seat 664. Lock cylinder 609 of the lock assembly 601 allows for a small amount of play therein to permit small angular movements of its torque blade 623 relative to the rotation axis L2 of the torque blade as illustrated in FIG. 27.

Figure 24:
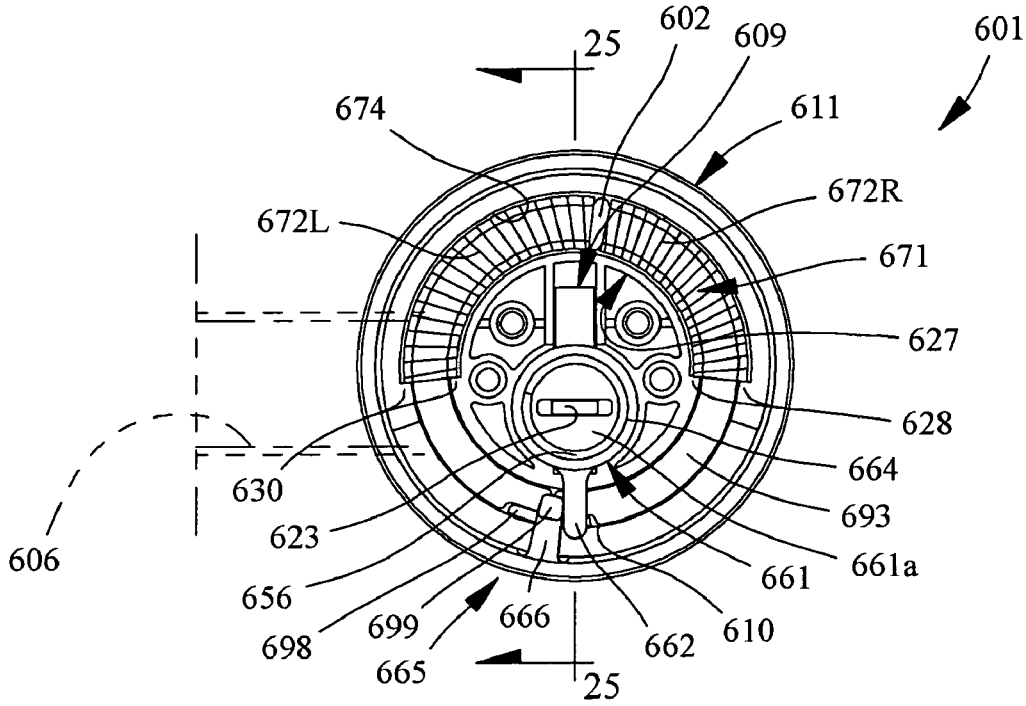
FIG. 24 is an end view of a keyless deadbolt door lock assembly according to a seventh embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a locator of the lock assembly omitted to show internal construction of the lock assembly.
Figure 26:
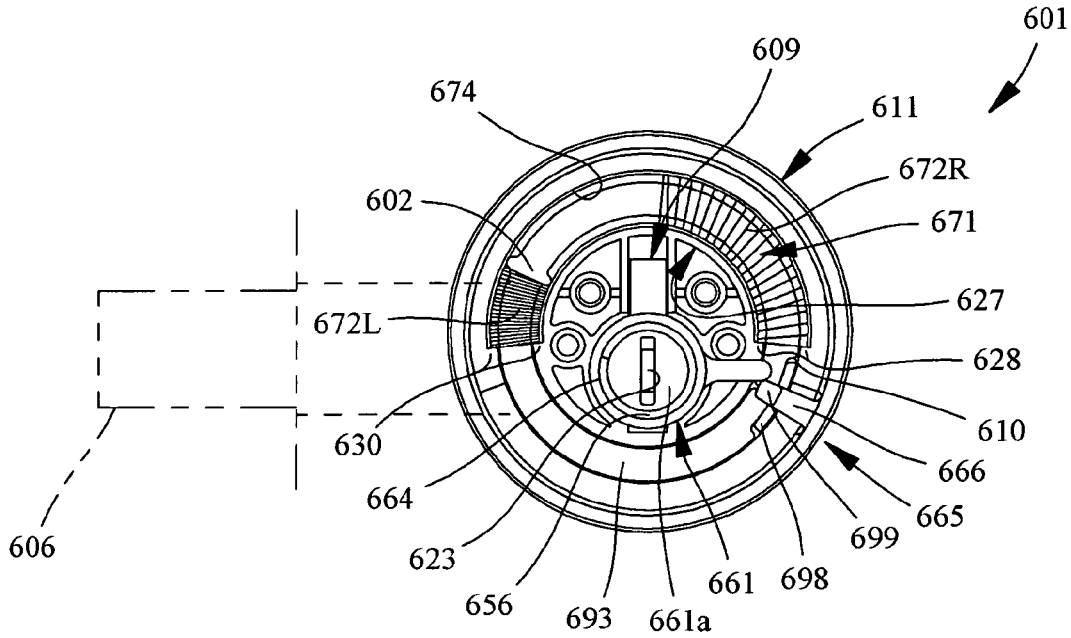
FIG. 26 is an end view similar to FIG. 24 with the ring illustrated in a rotated position and the actuator illustrated in a locked position corresponding to the locked position of the deadbolt.

FIG. 24 illustrates the lock assembly 601 operable in its counter-clockwise mode of operation with the ring 611 in its initial position and the actuator 661 in its unlocked position corresponding to the unlocked position of deadbolt 606. To lock the deadbolt, the ring 611 is rotated counter-clockwise toward its rotated position such that the actuator contact mechanism 665 (in the illustrated embodiment, the projection member 699 extending inward from the finger 666) contacts actuator arm 662 to rotate the actuator 661 to its locked position, which is illustrated in FIG. 26. The spring actuating member 698 contacts the spring carrier 693 within the recess 610 to conjointly rotate the spring carrier counter-clockwise with the ring 611. Upon rotation of the spring carrier 693, the spring seat 602 compresses the spring 672L between the seat and the shoulder pair 630 as illustrated in FIG. 26.

Upon release of the ring 611 following locking of the deadbolt 606, the bias of the compressed spring 672L urges the ring to return to its initial position while the actuator 661 (and hence the deadbolt) remains in its locked position until a key or thumbturn is used to unlock the deadbolt.

Figure 28:
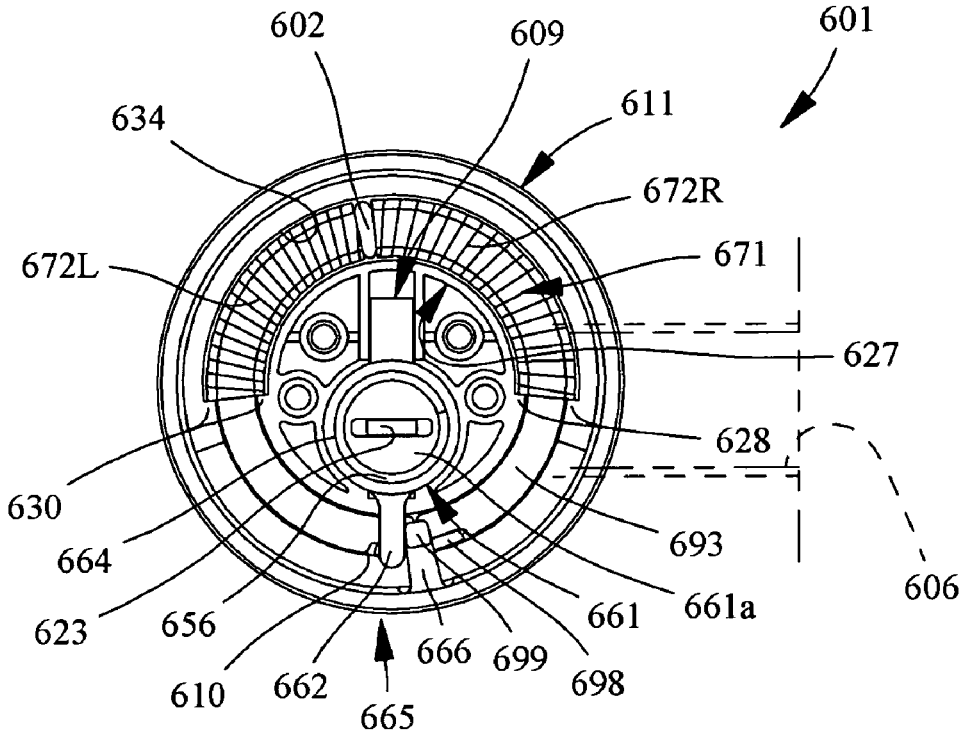
FIG. 28 is an end view similar to FIG. 24 with the lock assembly configured for clockwise operation, with the ring illustrated in an initial position and the actuator illustrated in an unlocked position corresponding to the unlocked position of the deadbolt.

For adjusting the lock assembly 601 for operation in the clockwise mode of operation, the ring 611 is positioned in its initial position and the actuator 661 is positioned in its unlocked position. The torque blade 623 is manually urged to move through an angular movement relative its rotation axis L2 (via the small amount of play between the lock cylinder 609 and torque blade) as shown in phantom in FIG. 27. Angular movement of the torque blade 623 conjointly angularly moves the actuator 661 to an adjustment position relative to the ring 611, and in particular relative to the actuator contact mechanism 665 (e.g., the projection member 699 extending inward from finger 666). The ring 611 (and actuator contact mechanism 665) can then be rotated relative to the actuator 661, with the ring finger 666 and its projection member 699 passing under the actuator arm 662 to position the projection member on the opposite side of the actuator arm as illustrated in FIG. 28.

The angular movement of the torque blade 623 and actuator 661 relative to the rotation axis L2 of the torque blade compresses the actuator spring 656 between the actuator and the locator stabilizing bridge 629. Upon release of the torque blade 623 following repositioning of the ring 611, the torque blade and actuator 661 are biased back to their original, operating positions on the rotation axis L2 of the torque blade 623 for normal operation of the lock assembly 601 in its clockwise mode of operation.

Thus, it will be seen that no disassembly of the lock assembly 601 is required to operate the lock assembly in its counter-clockwise and clockwise modes of operation. However, it is understood that where the lock assembly 601 is already installed on a door, the assembly may need to be removed from the door and separated from a thumbturn and backset to gain access to the torque blade 623 for angularly moving the torque blade.

Figure 29:
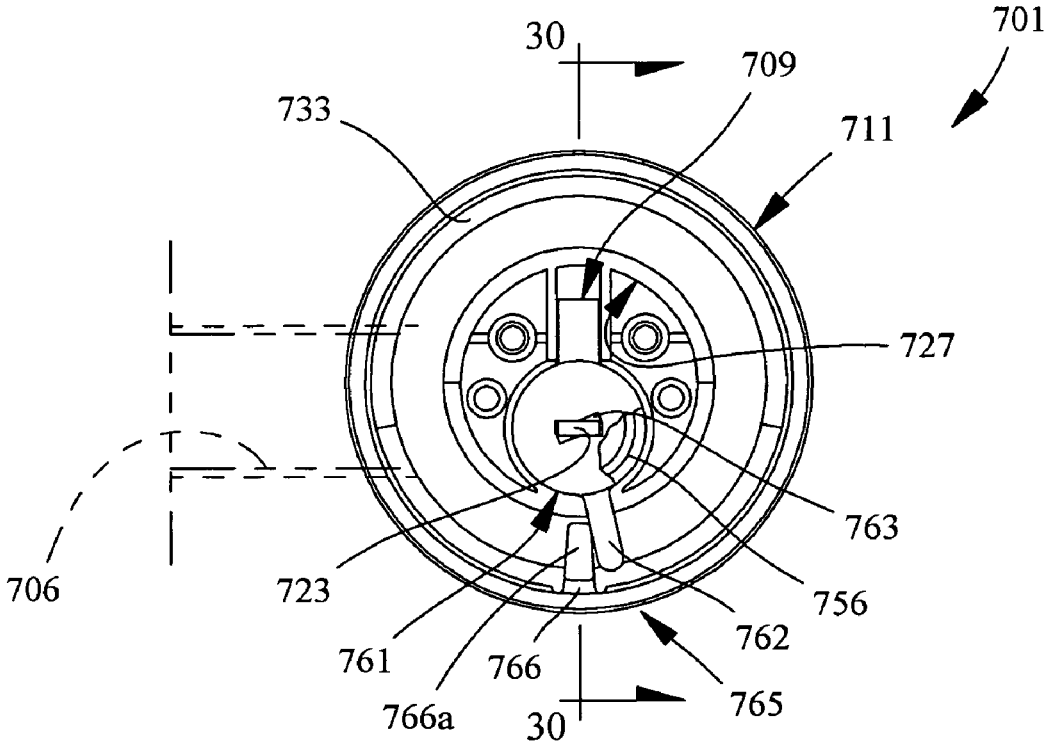
FIG. 29 is an end view of a keyless deadbolt door lock assembly according to an eighth embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a locator of the lock assembly omitted to show internal construction of the lock assembly.
Figure 30:
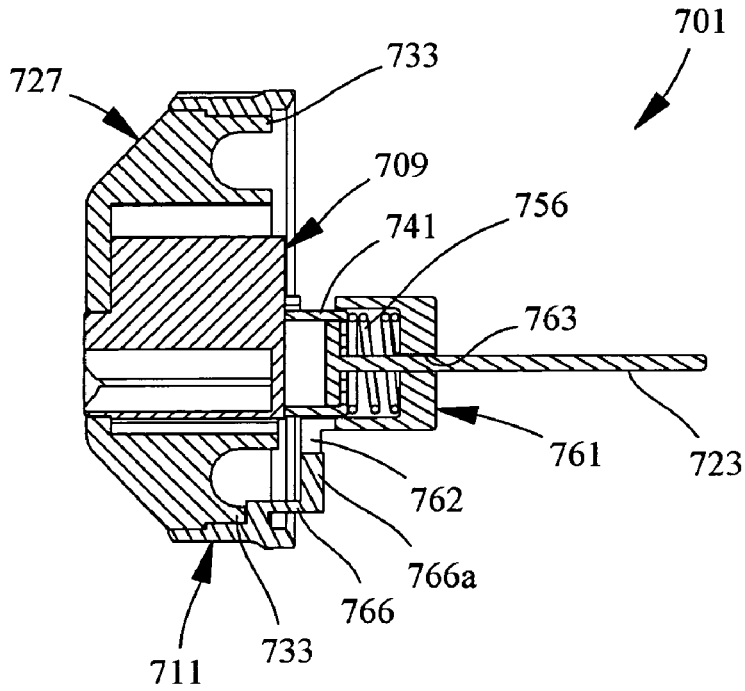
FIG. 30 is a cross-section taken in the plane of line 30-30 of FIG. 29.
Figure 31:
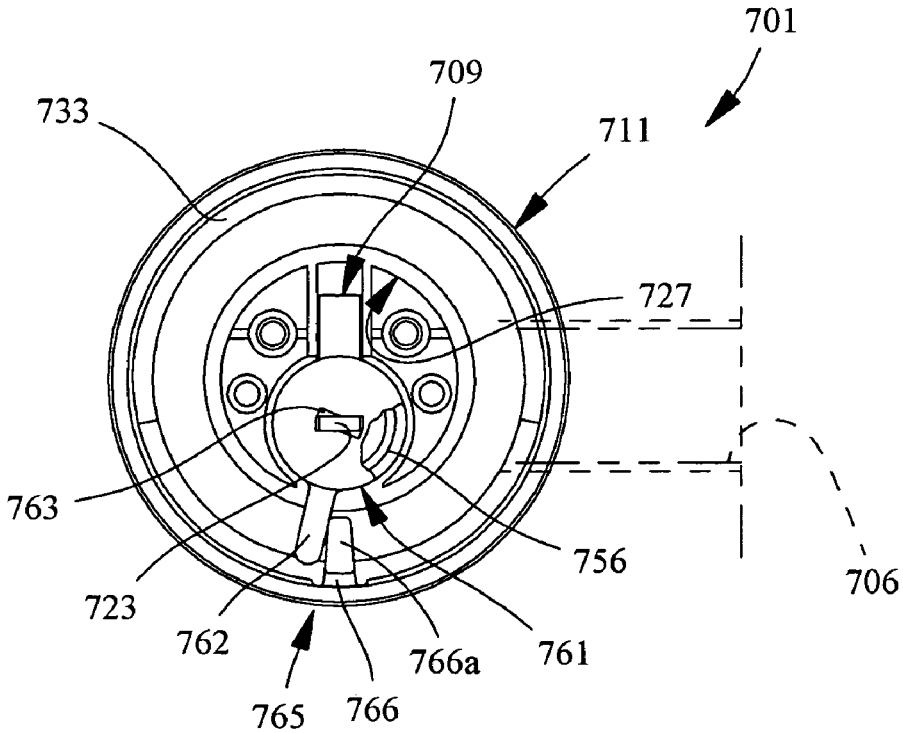
FIG. 31 is an end view similar to FIG. 29 with the lock assembly configured for clockwise operation, with the ring illustrated in an initial position and the actuator illustrated in an unlocked position corresponding to the unlocked position of the deadbolt.

FIGS. 29-31 illustrate a keyless deadbolt lock assembly, generally indicated at 701, according to an eighth embodiment. The lock assembly 701 is substantially similar to the lock assembly 601 of FIGS. 24-28 with the exception of slight modifications to ring 711 and actuator 761. In particular, actuator contact mechanism 765 connected to the ring 711 comprises a generally L-shaped finger 766 that extends radially inward from the inner surface of the ring to a free end 766*a* of the finger positioned rearward of arcuate flange 733 of body 727. The finger 766 may be formed separate from and subsequently connected (either permanently or releasably) to the ring 711, or the finger may be formed integrally with the ring.

The actuator 761 of this embodiment has a central generally butterfly-shaped opening 763 (FIG. 29) for receiving torque blade 723 therethrough to operatively connect the actuator with the torque blade. As in the previous embodiments and as shown in FIG. 30, the actuator 761 fits over inner end 741 (FIG. 30) of lock cylinder 709. An actuator spring 756 is disposed between the inner end 741 of the lock cylinder 709 and the actuator 761, generally about the torque blade 723 and within an outward/forward facing cavity formed by the cup-shaped actuator 761.

Operation of the lock assembly 701 in its counter-clockwise mode of operation (as configured in FIGS. 29 and 30) is substantially the same as that of the lock assembly 601 of FIGS. 24-28.

To adjust the lock assembly 701 to operate in the clockwise mode of operation (as configured in FIG. 31), the ring 711 is positioned in its initial position and the actuator 761 is positioned in its unlocked position (e.g., FIG. 29). Actuator arm 762 is accessible through a semi-circular opening in a lower half of a locator (not shown, but substantially the same as locator 31 and opening 42 of the first embodiment of FIGS. 1-10 and specifically FIGS. 3 and 4). The actuator arm 762 is manually grasped through the locator's semi-circular opening and pushed outward (not shown) generally toward the body 727 of the assembly 701 to an adjustment position out of angular alignment with the ring finger 766 (and particularly the free end 766*a* of the ring finger).

The actuator 761 is then rotated about the rotation axis L2 (see FIG. 3 illustrating the first embodiment) of the torque blade 723 (e.g., clockwise in the illustrated embodiment, compare FIG. 29 to FIG. 31) relative to the ring 711 (e.g., with the actuator arm 762 passing under the ring finger 766) to position the actuator arm on the opposite side of the ring finger as shown in FIG. 31. Upon rotating the actuator 761 in this manner, the actuator rotates relative to the torque blade 723 within the butterfly-shaped opening 763 in the actuator. The actuator arm 762 is released and the actuator spring 756 biases the actuator arm back to its original, operating position in angular alignment with the ring finger 766 for normal operation of the lock assembly 701 in its clockwise mode.

A biasing member is not illustrated in the embodiment of FIGS. 29-31. However, it is contemplated that any of the biasing members illustrated and described herein could be incorporated in the lock assembly 701 without departing from the scope of this invention.

Figure 32:
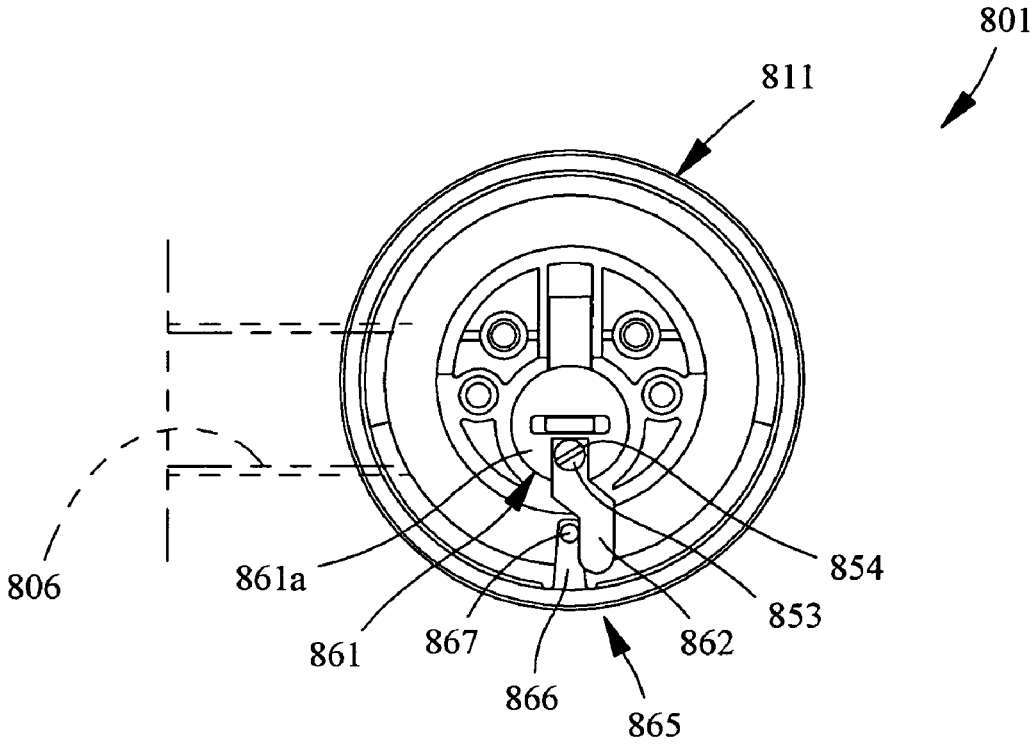
FIG. 32 is an end view of a keyless deadbolt door lock assembly according to a ninth embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a locator of the lock assembly omitted to show internal construction of the lock assembly.
Figure 33:
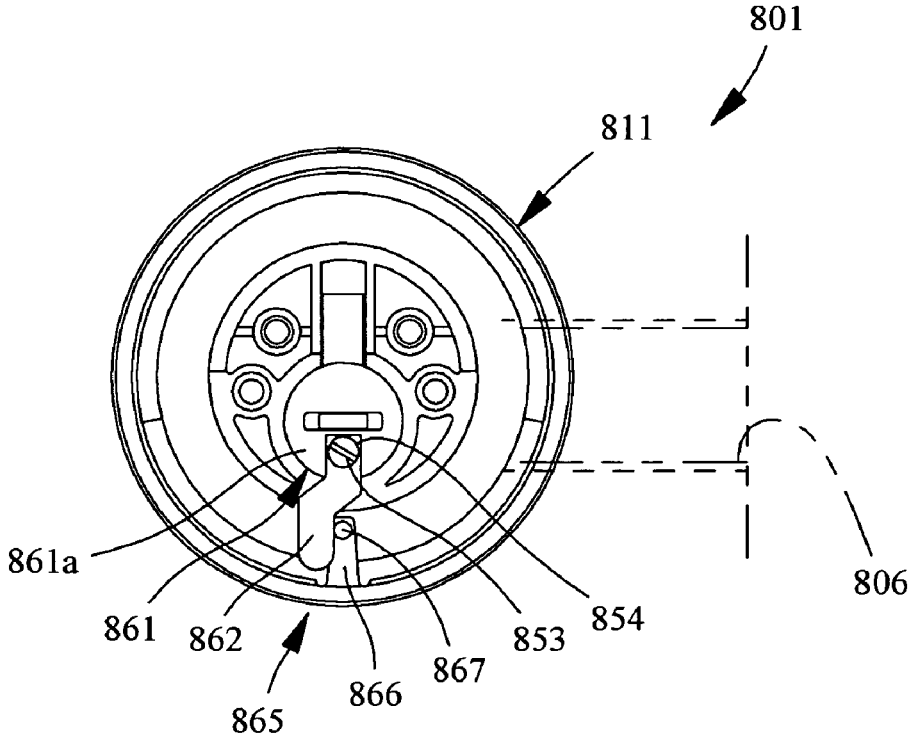
FIG. 33 is an end view similar to FIG. 32 with the lock assembly configured for clockwise operation, with the ring illustrated in an initial position and the actuator illustrated in an unlocked position corresponding to the unlocked position of the deadbolt.

FIGS. 32 and 33 illustrate a keyless deadbolt lock assembly (indicated generally at 801) according to a ninth embodiment of the invention in which actuator 861 is adjustable to operate the lock assembly in its counter-clockwise and clockwise modes of operation. In particular, the actuator 861 has an actuator arm 862 formed separate from and releasably connected to body 861*a* of the actuator. The arm 862 is generally Z-shaped or S-shaped and has a clearance opening 854 in the end nearest the actuator body 861*a* for receiving a threaded pin 853 to releasably and operatively connect the actuator arm 862 with the actuator body 861*a* at a threaded opening (not shown) in the body.

In this embodiment, actuator contact mechanism 865 connected to ring 811 comprises a radially inward extending finger 866 and a pin 867 extending rearward from the end of the finger for contact with the actuator arm 862 upon rotation of the ring 811. FIG. 32 illustrates the lock assembly 801 operable in its counter-clockwise mode of operation, with the actuator arm 862 oriented such that counter-clockwise rotation of the ring 811 brings the actuator contact mechanism 865 (i.e., the pin 867 in the illustrated embodiment) into contact with the actuator arm 862 to rotate the actuator 861 to its locked position (not shown, but substantially the same as in the previous embodiments) corresponding to the locked position of deadbolt 806. Operation of the lock assembly 801 is otherwise substantially the same as the lock assembly 1 of the first embodiment of FIGS. 1-10.

To operate the lock assembly 801 in its clockwise mode of operation (FIG. 33), the threaded pin 853 is removed from the actuator arm 862 and the arm is removed from the actuator 861. The actuator arm 862 is flipped over and secured to the actuator 861 using the threaded pin 853, with the actuator arm now on the opposite side of the actuator contact mechanism 865 (and in particular the pin 867 of the illustrated embodiment) as shown in FIG. 33.

Figure 34:
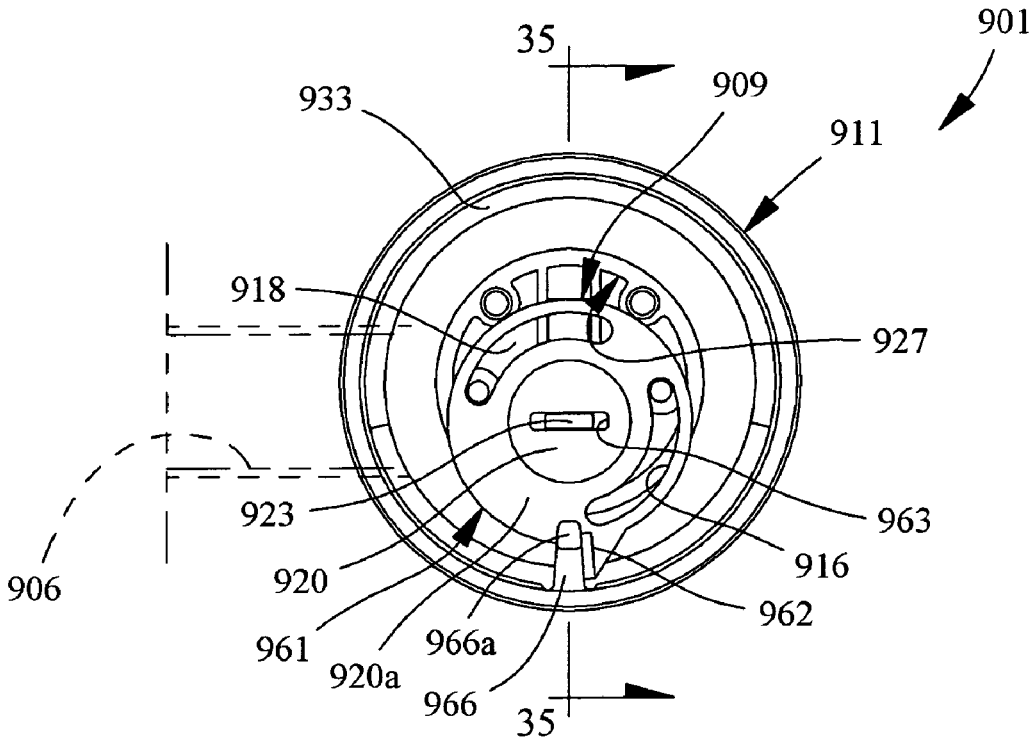
FIG. 34 is an end view of a keyless deadbolt door lock assembly according to a tenth embodiment configured for counter-clockwise operation on a left-hand door with a deadbolt backset and deadbolt illustrated in broken lines in an unlocked position of the deadbolt, a ring illustrated in an initial position and an actuator illustrated in an unlocked position, and a locator of the lock assembly omitted to show internal construction of the lock assembly.
Figure 35:
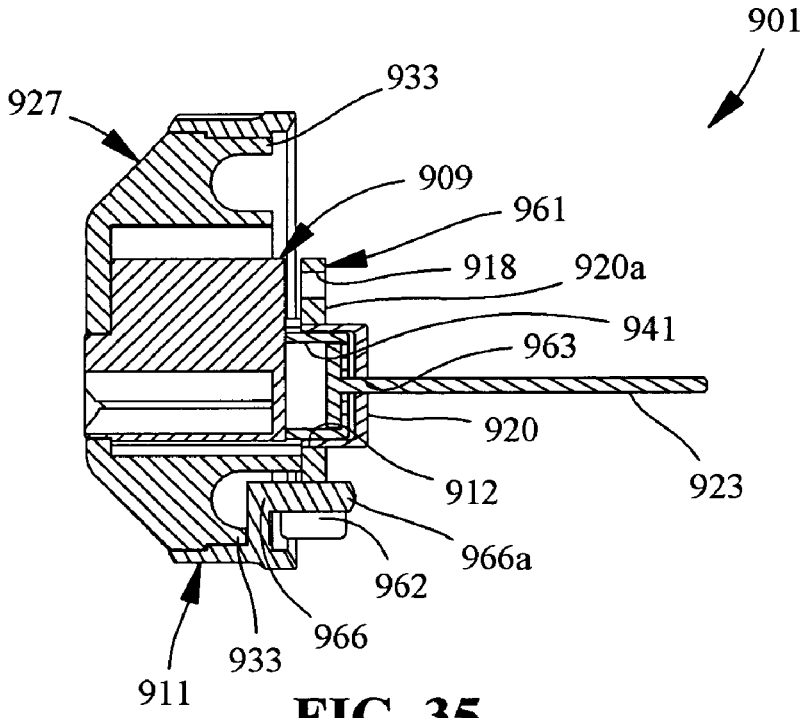
FIG. 35 is a cross-section taken in the plane of line 35-35 of FIG. 34.
Figure 36:
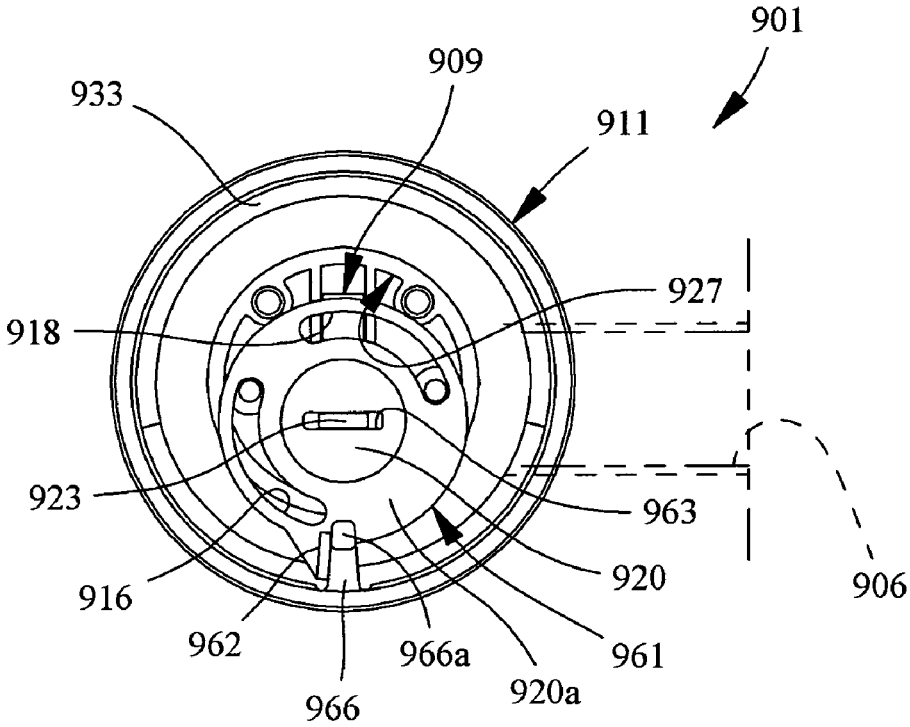
FIG. 36 is an end view similar to FIG. 34 with the lock assembly configured for clockwise operation, with the ring illustrated in an initial position and the actuator illustrated in an unlocked position corresponding to the unlocked position of the deadbolt.

In a tenth embodiment, illustrated in FIGS. 34-36, the lock assembly, indicated generally at 901, is substantially similar to the lock assembly 801 of the ninth embodiment, with the exception of actuator 961. In particular, the actuator 961 of this embodiment comprises a flat, generally circular plate 920*a* having a central opening 912 (FIG. 35) sized to fit over inner end 941 of lock cylinder 909. Circumferential extending slots 916, 918 are formed in the actuator 961 between the central opening 912 and a periphery of the actuator. The actuator 961 further comprises an arm 962 extending radially outward from the plate 920*a* and positioned for contact with actuator contact mechanism 965 (specifically, L-shaped finger 966 of the actuator contact mechanism that extends radially inward from ring 911 and terminates in free end 966*a* rearward of arcuate flange 933 of body 927).

As best illustrated in FIG. 35, the ring finger 966 is formed integral with the ring 911 and is generally L-shaped. A cup-shaped cap 920 holds the actuator 961 on the inner end 941 of the lock cylinder 909 and operatively connects the actuator to torque blade 923 of the lock cylinder. The cap 920 fits over the inner end 941 of the cylinder 909 and removeably secures to the plate 920*a* of the actuator 961 by suitable means, for example, a correspondingly threaded connection. The cap 920 of the actuator 961 has an opening 963 therein that receives the torque blade 923 and operatively connects the two together.

In a counter-clockwise operation of the lock assembly 901, the ring 911 is rotated from its initial position (FIG. 34) toward its rotated position in a counter-clockwise direction. The ring finger 966 rotates with the ring 911 to contact the actuator arm 962 and thus rotates the actuator 961 conjointly with the ring to position the actuator in its locked position (not shown, but substantially the same as in the previous embodiments) corresponding to the locked position of deadbolt 906. Upon release of the ring 911, the ring is urged by a biasing member (not shown) back to its initial position while the actuator 961 remains in its locked position until the deadbolt 906 is unlocked by using a key or thumbturn. While the biasing member is not illustrated in the embodiment of FIGS. 34-36, it is understood that any of the biasing members illustrated and described herein may be incorporated in the lock assembly 901 without departing from the scope of this invention.

For operation of the assembly 901 in the clockwise mode of operation, the actuator 961 is flipped over (FIG. 36). The actuator plate 920*a* is released from the actuator cap 920 and removed from the lock cylinder 909, and the actuator plate is flipped over so that the arm 962 is now on the opposite side of the ring finger 966. The actuator plate 920*a* is then reconnected to the actuator cap 920 over the inner end 941 of the lock cylinder 909.

Figure 37:
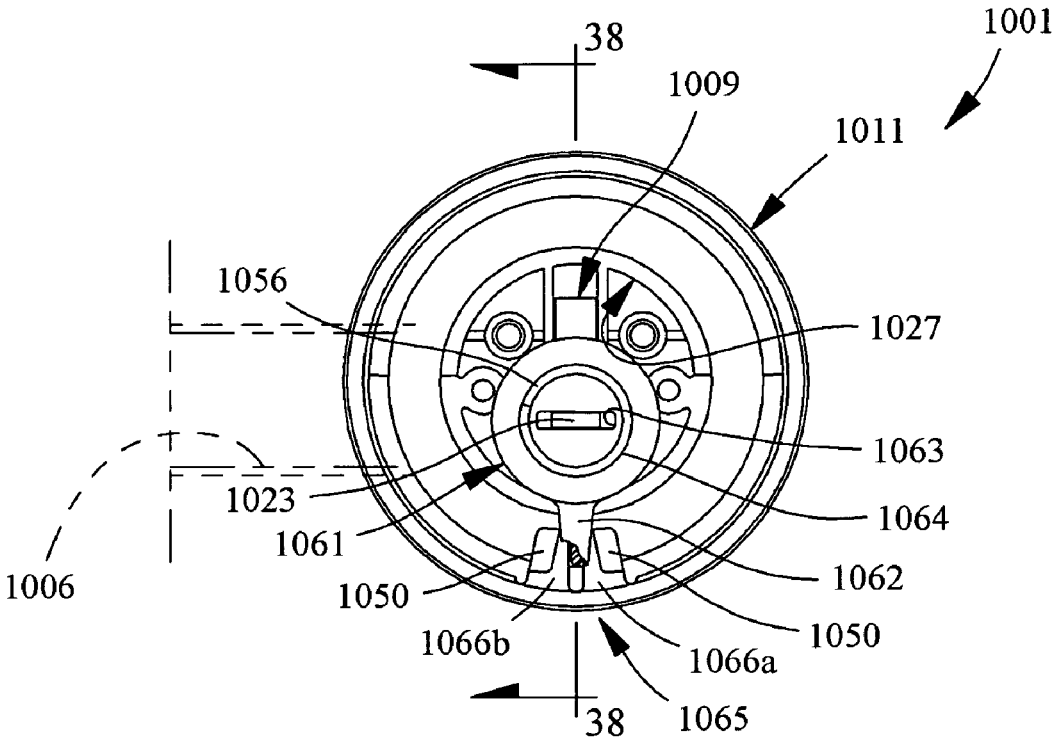
FIG. 37 is an end view of a keyless deadbolt door lock assembly according to an eleventh embodiment configured for operation on a left-hand door with a deadbolt backset and deadbolt illustrated in broken lines at an unlocked position, a ring illustrated in an initial position and an actuator illustrated in an unlocked position, and a locator of the lock assembly omitted to show internal construction of the lock assembly.
Figure 38:
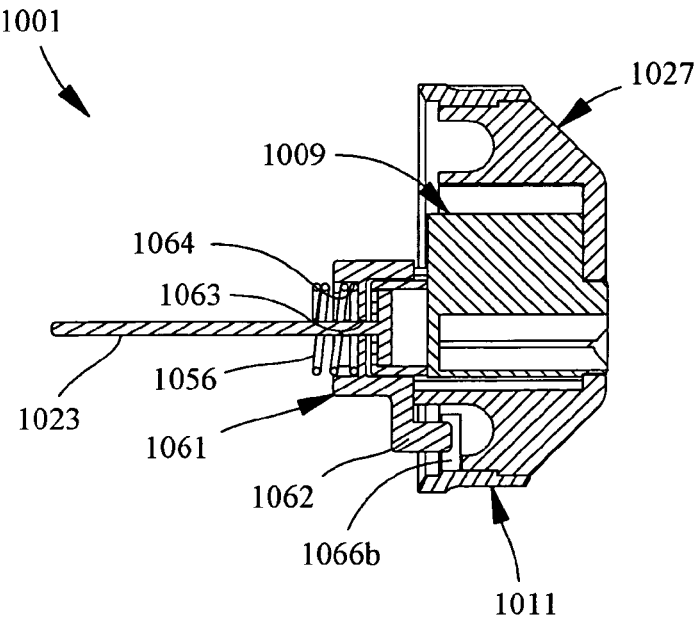
FIG. 38 is a cross-section taken in the plane of line 38-38 of FIG. 37.
Figure 39:
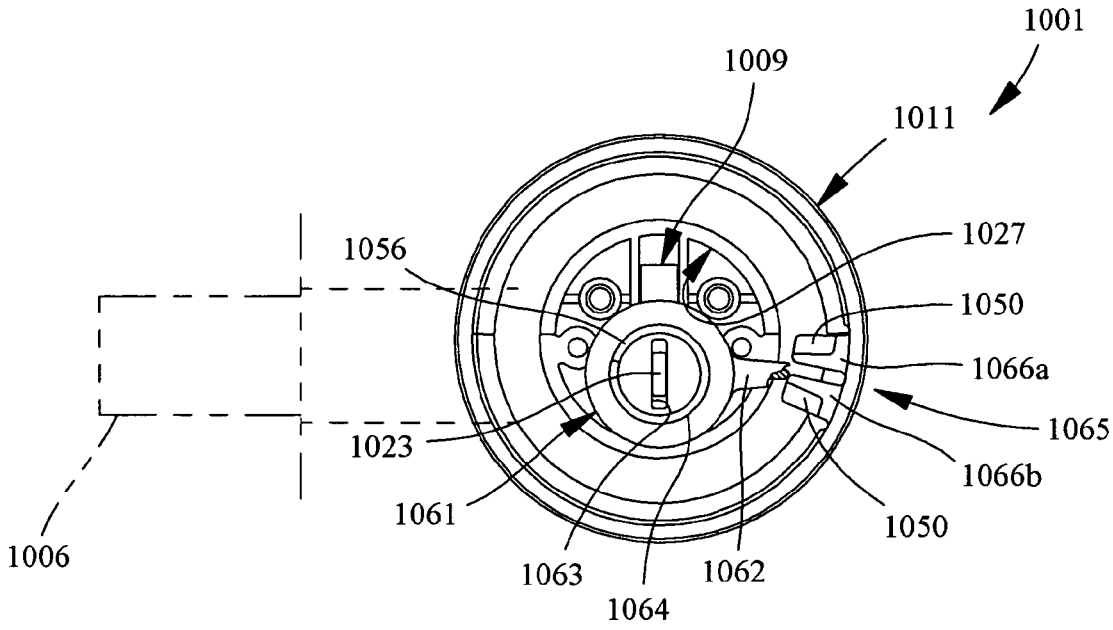
FIG. 39 is an end view similar to FIG. 37 with the ring illustrated in a rotated position and the actuator illustrated in a locked position corresponding to the locked position of the deadbolt.

FIGS. 37-39 illustrate a keyless deadbolt door lock assembly (generally indicated at 1001) according to an eleventh embodiment of the invention. While a biasing member is not illustrated in the embodiment of FIGS. 37-39, it is understood that any of the biasing members illustrated and described herein may be incorporated in the lock assembly 1001 without departing from the scope of this invention.

The lock assembly 1001 of this eleventh embodiment is suitably configured for operation in its counter-clockwise and clockwise operating modes without adjustment or disassembly of any of the lock assembly components. In particular, actuator contact mechanism 1065 of the lock assembly 1001 comprises a pair of opposed fingers 1066*a*, 1066*b* extending radially inward from the inner surface of the ring 1011 in angular spaced relationship with each other. The angular spacing between the fingers 1066*a*, 1066*b* is approximately equal to or slightly greater than the width of arm 1062 of actuator 1061. Each of the fingers 1065*a*, 1065*b* has a respective cam surface 1050 that slopes circumferentially inward from the outward side of each finger to its inward side.

Actuator 1061 is cup-shaped and actuator arm 1062 is L-shaped (FIG. 38) and extends radially outward from the actuator. An actuator spring 1056 seats within cavity 1064 of the cup-shaped actuator 1061, with torque blade 1023 of lock cylinder 1009 extending through the spring and through opening 1063 of the actuator. The actuator spring 1056 is held in place between the actuator 1061 and a locator stabilizing bridge (not shown, but substantially the same as the stabilizing bridge 29 of the locator 31 of the first embodiment of FIGS. 1-10, specifically FIGS. 2 and 3) to maintain the actuator arm 1062 between the ring fingers 1065*a*, 1065*b* during operation.

FIG. 37 illustrates the lock assembly 1001 operable in a counter-clockwise operating mode. In the initial position of the ring 1011 and in the unlocked position of the actuator 1061 corresponding to the unlocked position of deadbolt 1006, the actuator arm 1062 extends down between the ring fingers 1066*a*, 1066*b*. Rotation of the ring 1011 about body 1027 toward its rotated position in the counter-clockwise direction rotates ring finger 1066*b* conjointly therewith into contact with the actuator arm 1062 to rotate the actuator 1061 to its locked position (FIG. 39) corresponding to the locked position of the deadbolt 1006.

The actuator 1061 particularly rotates about a rotation axis L2 offset from a rotation axis L1 of the ring 1011 (this is shown with respect to the first embodiment of FIGS. 1-10 in FIG. 1) such that upon rotation of the ring to its rotated position (e.g., about 90°), the actuator arm 1062 disengages from between the ring fingers 1066*a*, 1066*b*. The biasing member (not shown) of the lock assembly 1001 acts on the ring 1011 to return the ring to its initial position while the actuator 1061 remains in its locked position until a key or thumbturn is used to unlock the deadbolt 1006.

As the actuator 1061 is rotated back toward its unlocked position, actuator arm 1062 contacts the cam surface 1050 of the ring finger 1066*a*. The cam surface 1050 urges the actuator arm 1062 against the bias of the actuator spring 1056 inward/rearward until the actuator arm passes over the ring finger 1066*a* to the unlocked position of the actuator 1061 in which the actuator arm 1062 is between the ring fingers 1066*a*, 1066*b*. The bias of the actuator spring 1056 urges the actuator arm 1062 back between the ring fingers 1066*a*, 1066*b*.

Where operation of the lock assembly 1001 in the clockwise mode of operation (not shown) is required to lock the deadbolt 1006, no adjustment or disassembly of the lock assembly is necessary. The initial position of the ring 1011 and the unlocked position of the actuator 1061 is substantially the same as shown in FIG. 37. But in the clockwise mode of operation, the ring 1011 may be readily rotated in the clockwise direction to its rotated position for locking the deadbolt 1006.

FIGS. 40-43 illustrate a keyless deadbolt lock assembly, generally indicated at 1101, according to a twelfth embodiment of the present invention. While a biasing member of the lock assembly 1101 is not illustrated in the embodiment of FIGS. 40-43, it is understood that any of the biasing members illustrated and described herein could be incorporated in the assembly without departing from the scope of this invention.

Figure 40:
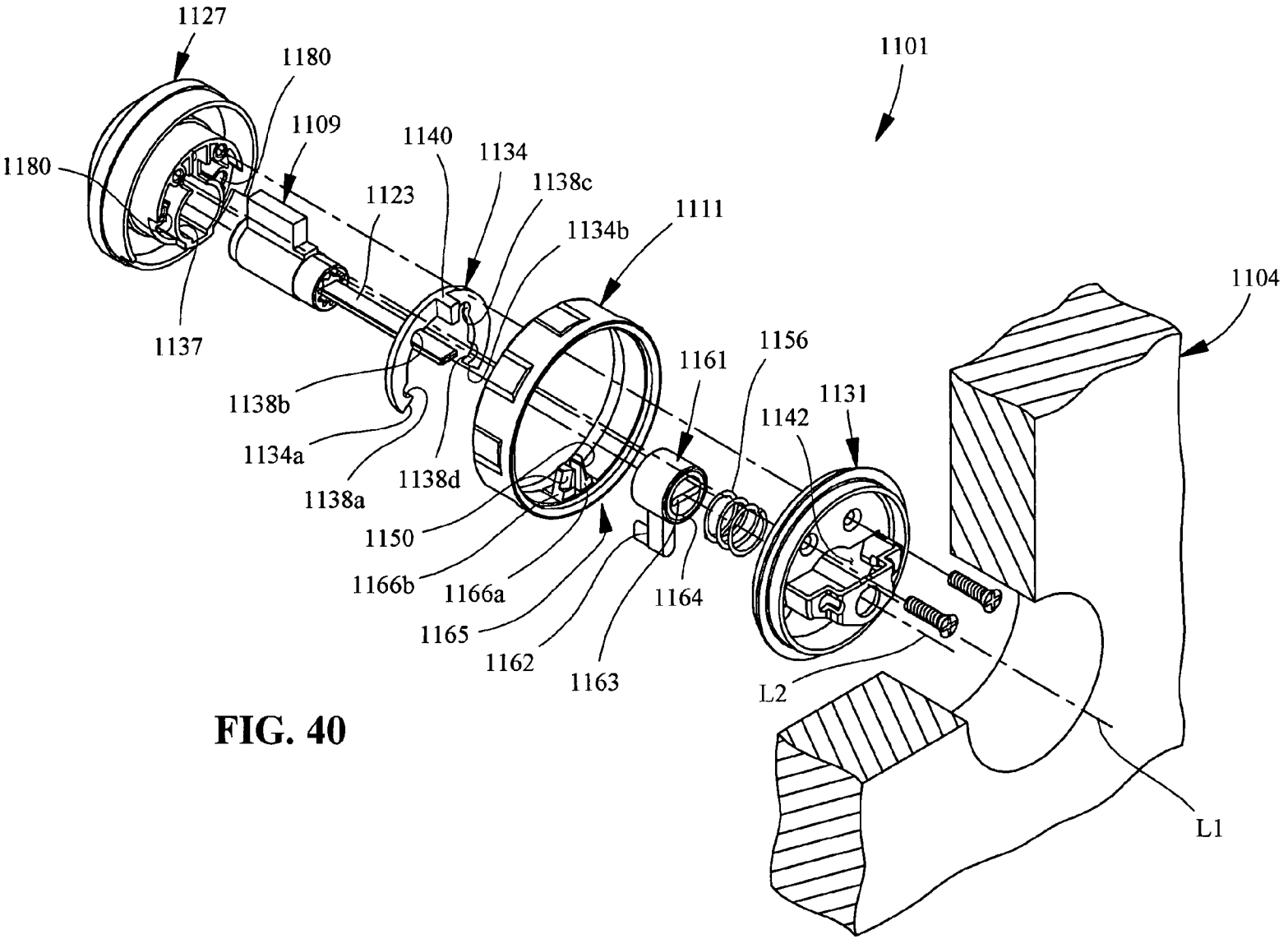
FIG. 40 is an exploded perspective of a keyless deadbolt door lock assembly according to a twelfth embodiment with a biasing member omitted for illustrative purposes.

The lock assembly 1101 is substantially similar to the lock assembly 1001 of FIGS. 37-39 and further comprises a backstop, generally designated 1134. Parts of the assembly 1001 of FIGS. 37-39 corresponding to parts of the assembly 1101 of this embodiment are designated by the same reference numerals, plus "100". With particular reference to FIG. 40, the backstop 1134 is generally C-shaped and has four notches 1138*a-d* angularly spaced along its inner perimeter for accommodating mounting screws (not shown) similar to the mounting screws 25 of the first embodiment (FIG. 2). A tab 1140 projects rearward from the top center position (as configured in FIG. 40) of the backstop 1134, e.g., between the second and third notches 1138*b* and 1138*c*, for grasping the backstop and adjusting it, as will be further described.

Figure 41:
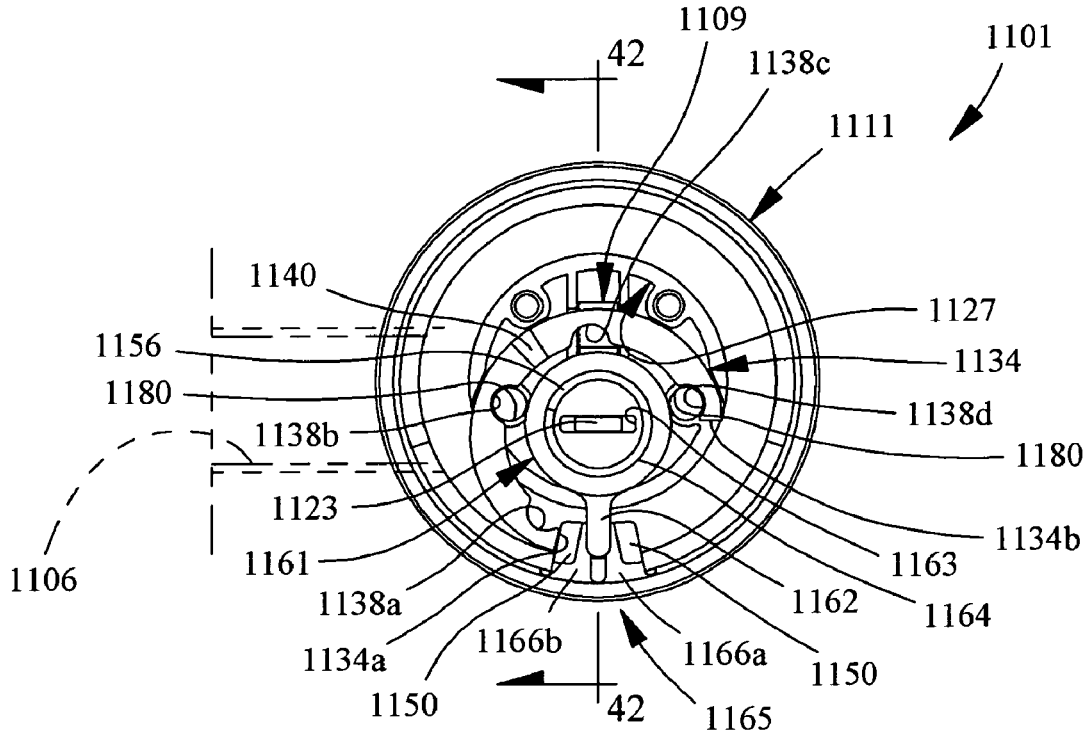
FIG. 41 is an end view of the lock assembly of FIG. 40 configured for counter-clockwise operation on a left-hand door with a deadbolt backset and deadbolt illustrated in broken lines at an unlocked position of the deadbolt, a ring illustrated in an initial position and an actuator illustrated in an unlocked position, and a locator of the lock assembly omitted to show internal construction of the lock assembly.
Figure 42:
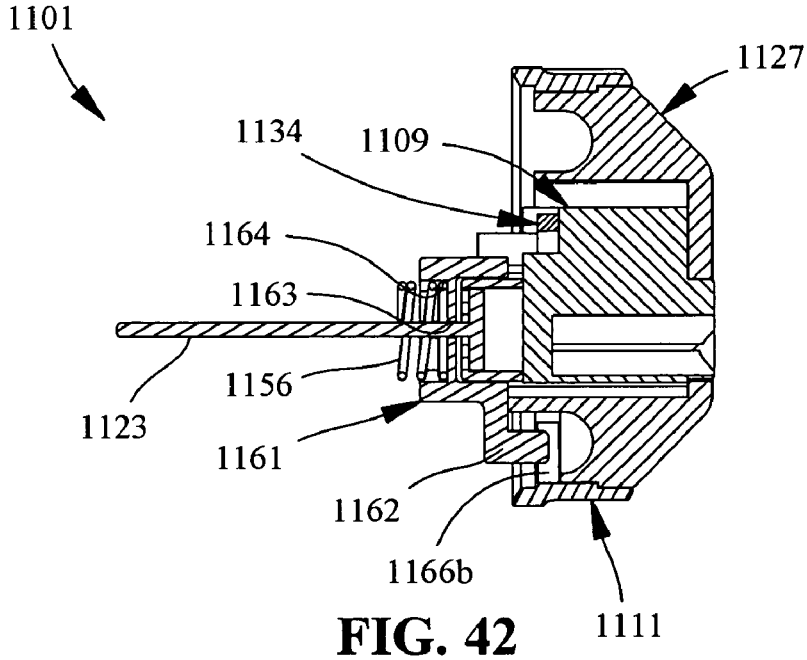
FIG. 42 is a cross-section taken in the plane of line 42-42 of FIG. 41.
Figure 43:
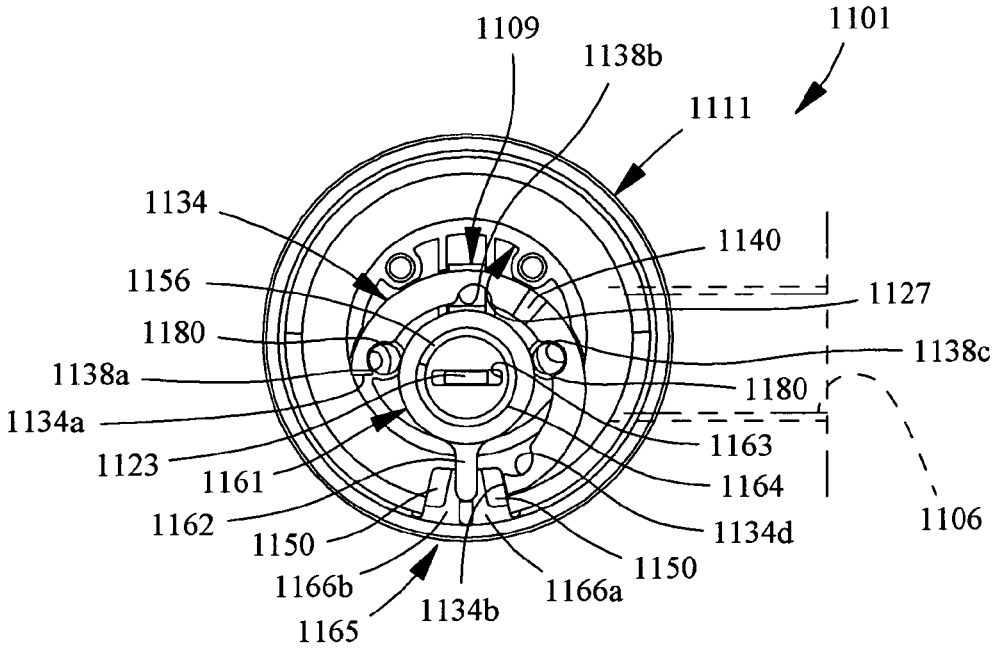
FIG. 43 is a view similar to FIG. 41 with the assembly configured for clockwise operation, with the ring illustrated in an initial position and the actuator illustrated in an unlocked position corresponding to the unlocked position of the deadbolt.

FIGS. 41 and 42 illustrate operation of the lock assembly 1101 in the counter-clockwise mode of operation. The backstop 1134 is located between lock assembly body 1127 and locator 1131, generally around lock cylinder 1109 (FIG. 42). The backstop 1134 is oriented such that the mounting screws used to install the assembly 1101 on the door engage the backstop 1134 at its second and fourth notches 1138*b* and 1138*d* (FIG. 41) and connect it to the body 1127 at screw openings 1180 generally within channel 1137. A first end 1134*a* of the backstop 1134 engages ring 1111, and more particularly the actuator contact mechanism 1165, at about cam surface 1150 of second finger 1166*b*. This prevents the ring 1111 from rotating clockwise (as viewed in FIG. 41), thereby providing feedback to the user that the lock assembly 1101 is in its counter-clockwise mode of operation to lock deadbolt 1106.

For operation of the lock assembly 1101 in the clockwise operating mode (FIG. 43), the backstop 1134 is instead oriented such that the mounting screws engage the backstop at its first and third screw openings 1138*a*, 1138*c*, and opposite end 1134*b* of the backstop 1134 engages the cam surface 1150 of finger 1166*a* of the actuator contact mechanism 1165 on the ring 1111. In this configuration, the backstop 1134 prevents the ring 1111 from rotating counter-clockwise to indicate to the user that the lock assembly 1101 is operable in the clockwise operating mode to lock the deadbolt 1106.

The backstop 1134 can easily be moved for operation in either the counter-clockwise or clockwise mode of operation by grasping the backstop tab 1140 through semicircular opening 1142 of locator 1131 to rotate the backstop 1134 about the lock cylinder 1109 (and channel 1137) and orient it in the desired blocking position. The backstop 1134 is retained in the selected blocking position by the mounting screws once the assembly 1101 is installed on a door.

FIGS. 44-47 illustrate a thirteenth embodiment of a keyless deadbolt lock assembly (generally indicated at 1201) substantially similar to the lock assembly 1101 of FIGS. 40-43 but with a different backstop configuration. In particular in this embodiment, the backstop, indicated generally at 1234, comprises a generally C-shaped member 1215 having a pair of angularly spaced notches 1246*a*, 1246*b* in its inward facing side and angularly opposed ends 1234*a*, 1234*b*.

Figure 45:
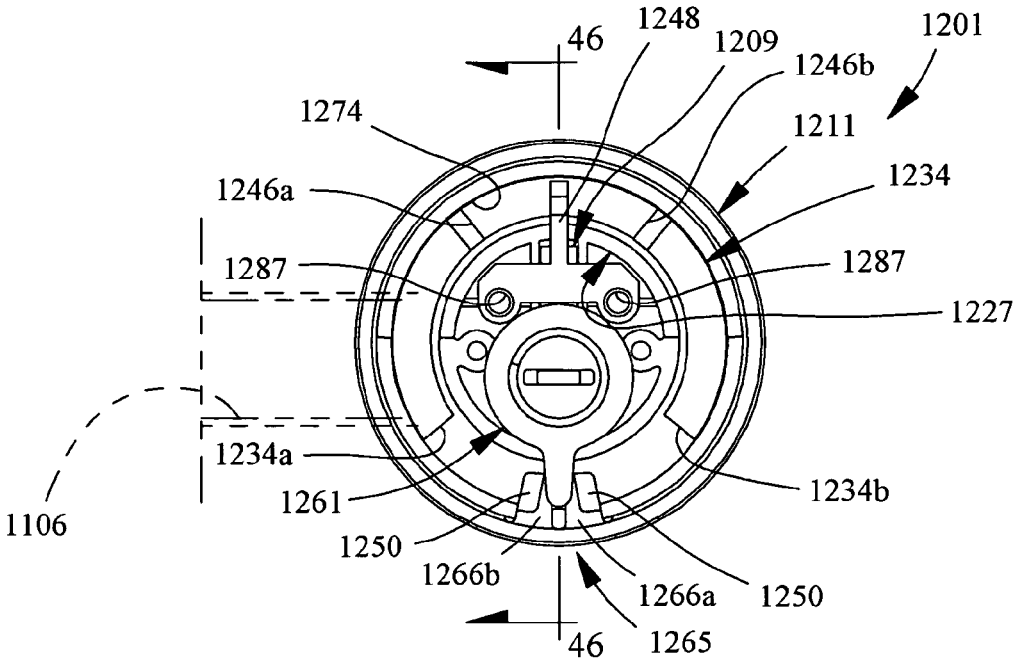
FIG. 45 is an end view of the lock assembly of FIG. 44 with a ring illustrated in an initial position and an actuator illustrated in an unlocked position, and a locator of the lock assembly omitted to show internal construction of the lock assembly.
Figure 44:
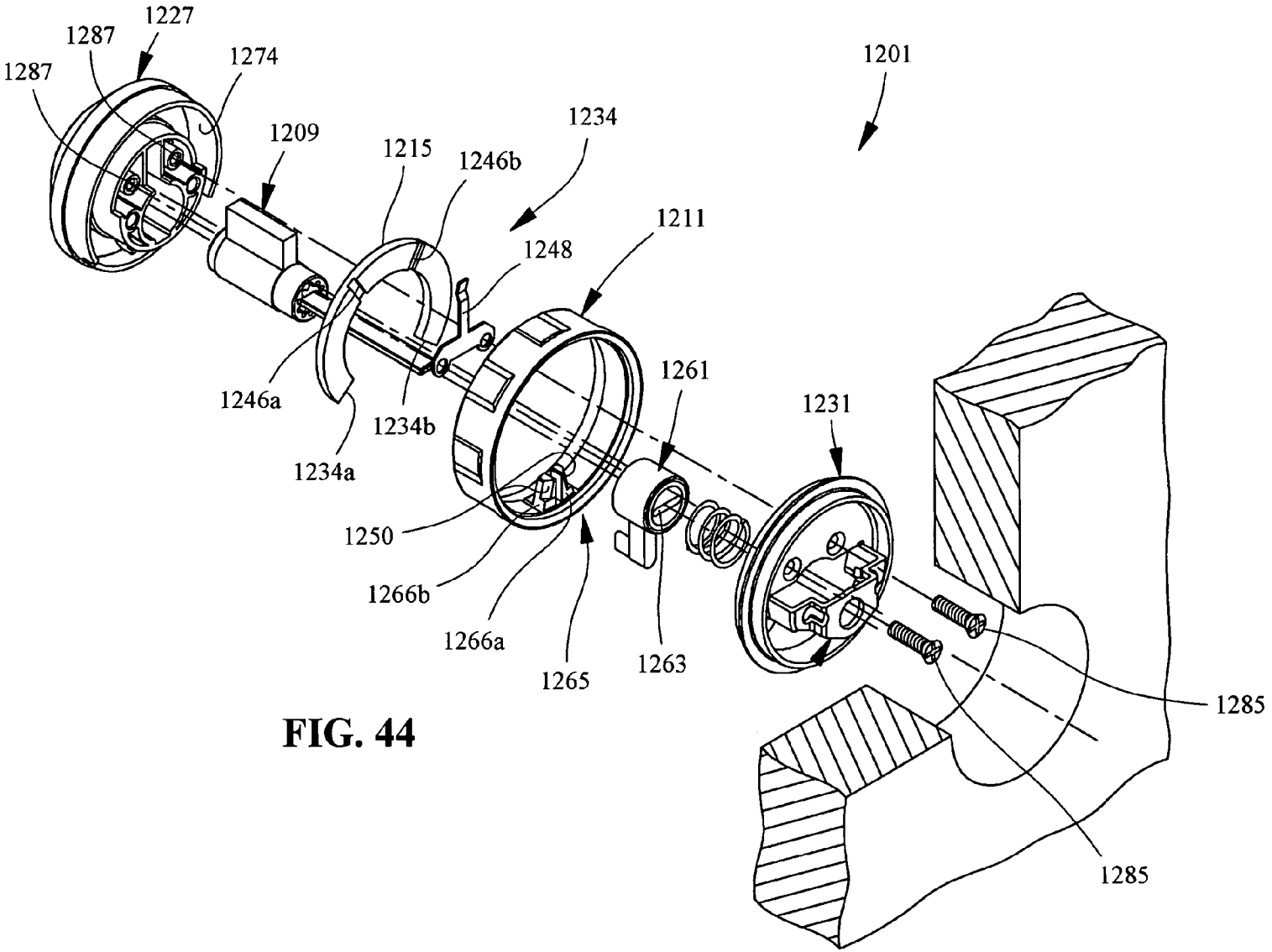
FIG. 44 is an exploded perspective of a keyless deadbolt door lock assembly according to a thirteenth embodiment with a biasing member omitted for illustrative purposes.
Figure 46:
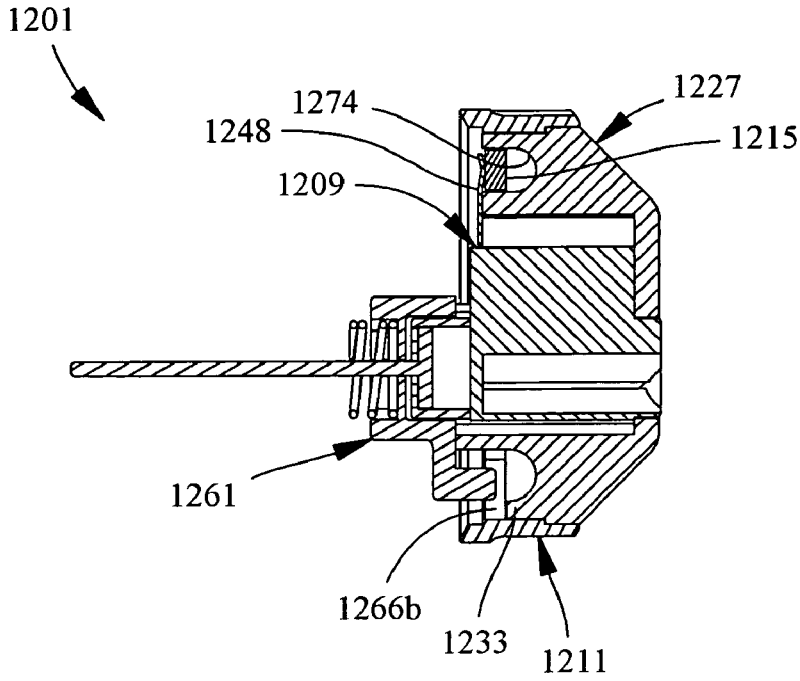
FIG. 46 is a cross-section taken in the plane of line 46-46 of FIG. 45.
Figure 47:
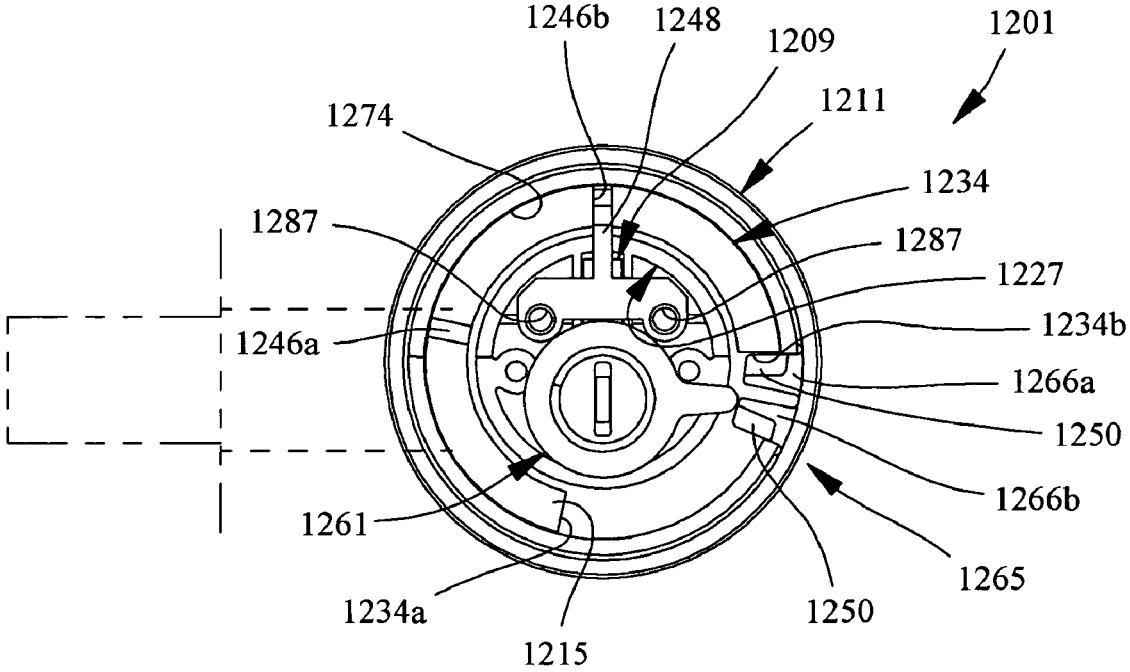
FIG. 47 is an end view similar to FIG. 45 with the ring illustrated in a rotated position and the actuator illustrated in a locked position corresponding to the locked position of the deadbolt.

The C-shaped member 1215 is disposed between lock assembly body 1227 and locator 1231 generally circumferentially about lock cylinder 1209 and within channel 1274 of the body (FIG. 46). The backstop further comprises a T-shaped spring finger 1248 (FIG. 44) disposed inward of the C-shaped member 1215 and connected to the body 1227 by assembly screws 1285 at mounting members 1287 of the body. FIG. 45 illustrates the lock assembly 1201 prior to an initial selection of the operating mode of the lock assembly with the spring finger 1248 in contact with the inward facing side of the C-shaped member 1215 between the notches 1246*a*, 1246*b*. For operation in the counter-clockwise operating mode of the lock assembly 1201, ring 1211 (and actuator contact mechanism 1265) is rotated counter-clockwise to move actuator 1261 to its locked position as shown in FIG. 47 (substantially as described for the eleventh embodiment of FIGS. 37-39). During this initial operation, the ring finger 1266*a* (generally at cam surface 1250) engages end 1234*b* of the C-shaped member 1215 and rotates the C-shaped member conjointly with the ring 1211 in the counter-clockwise direction. The notch 1246*b* of the C-shaped member 1215 rotates into alignment with the spring finger 1248 (FIG. 47) whereby the spring finger seats in the notch to releasably secure the C-shaped member 1215 in a blocking position where the backstop 1234 blocks operation of the lock assembly in the clockwise operating mode.

For operation in the clockwise operating mode (not shown), the ring 1211 may instead be initially rotated in a clockwise direction such that the spring finger 1248 seats in the notch 1246*a* of the C-shaped member 1215 of the backstop 1234.

Components of the various embodiments of the keyless deadbolt lock assembly of the invention are made of a suitable rigid material, such as metal (e.g., steel). But assemblies made of a nonmetallic material, specifically including plastic, do not depart from the scope of this invention.

When introducing elements of the present invention, the articles "a", "an", "the" and "said" are intended to mean that there are one or more of the elements. The terms "comprising", "including" and "having" are intended to be inclusive and mean that there may be additional elements other than the listed elements.

As various changes could be made in the above assemblies without departing from the scope of the invention, it is intended that all matter contained in the above description and shown in the accompanying drawings shall be interpreted as illustrative and not in a limiting sense.

What is claimed is:

1. A deadbolt door lock assembly for keyless operation of a deadbolt from an unlocked position to a locked position of the deadbolt, the lock assembly comprising:

an actuator operatively connected to the deadbolt and having a rotation axis, the actuator being rotatable on said rotation axis from an unlocked position corresponding to the unlocked position of the deadbolt to a locked position corresponding to the locked position of the deadbolt;

a ring rotatable relative to the actuator from an initial position of the ring to a rotated position thereof;

an actuator contact mechanism operatively connected to the ring for conjoint rotation therewith, the actuator contact mechanism being configured and arranged for contact with the actuator in the unlocked position of the actuator upon rotation of the ring from its initial position toward its rotated position to rotate the actuator from the unlocked position of the actuator to its locked position; and a biasing member urging the actuator contact mechanism away from contact with the actuator in the locked position of the actuator;

the lock assembly being operable in a clockwise operating mode and a counter-clockwise operating mode, in the clockwise operating mode the ring being rotatable in a clockwise direction to rotate the actuator from its unlocked position to its locked position to lock the deadbolt, in the counter-clockwise operating mode the ring being rotatable in the counter-clockwise direction to rotate the actuator from its unlocked position to its locked position to lock the deadbolt, the lock assembly being operable between the clockwise operating mode and the counter-clockwise operating mode without removing the biasing member from said lock assembly.

2. The lock assembly set forth in claim 1 wherein the lock assembly is operable between the clockwise operating mode and the counter-clockwise operating mode without adjustment of the biasing member.

3. The lock assembly set forth in claim 2 wherein in the locked position of the actuator and the initial position of the ring the actuator is configurable between a first configuration corresponding to the clockwise operating mode of the lock assembly and a second configuration different from said first configuration and corresponding to the counter-clockwise operating mode of the lock assembly.

4. The lock assembly set forth in claim 3 wherein at least a portion of the actuator is releasably removable from the lock assembly to configure the actuator between its first and second configurations.

5. The lock assembly set forth in claim 4 wherein the actuator comprises a body operatively connecting the actuator with the deadbolt, and an arm extending out from the body for contact by the actuator contact mechanism upon rotation of the ring from its initial position toward its rotated position, said arm being releasably connected to the body for orienting the arm relative to the body in a first orientation corresponding to the first configuration of the actuator and a second orientation corresponding to the second configuration of the actuator.

6. The lock assembly set forth in claim 1 wherein the lock assembly is operable between the clockwise operating mode and the counter-clockwise operating mode without removing the actuator from said lock assembly.

7. The lock assembly set forth in claim 6 wherein the actuator contact mechanism is selectively configurable between a first configuration corresponding to the clockwise operating mode of the lock assembly and a second configuration corresponding to the counter-clockwise operating mode of the lock assembly.

8. The lock assembly set forth in claim 7 wherein the initial position of the ring in the clockwise operating mode of the lock assembly is different from the initial position of the ring in the counter-clockwise operating mode of the lock assembly, the actuator contact mechanism being in its first configuration in the initial position of the ring in the clockwise operating mode of the lock assembly, said actuator contact mechanism being it its second configuration in the initial position of the ring in the counter-clockwise operating mode of the lock assembly.

9. The lock assembly set forth in claim 8 wherein at least a portion of the actuator contact mechanism is releasable from operative connection with the ring to permit rotation of the ring relative to the actuator between the initial position of the ring in the clockwise operating mode of the lock assembly to the initial position of the ring in the counter-clockwise operating mode of the lock assembly.

10. The lock assembly set forth in claim 7 wherein the initial position of the ring in the clockwise operating mode of the lock assembly is substantially the same as the initial position of the ring in the counter-clockwise operating mode of the lock assembly.

11. The lock assembly set forth in claim 10 wherein at least a portion of the actuator contact mechanism is releasable from operative connection with the ring for configuring the actuator contact mechanism between its first configuration corresponding to the clockwise operating mode of the lock assembly and its second configuration corresponding to the counter-clockwise operating mode of the lock assembly.

12. The lock assembly set forth in claim 6 wherein in the locked position of the actuator and the initial position of the ring the actuator is configurable between a first configuration corresponding to the clockwise operating mode and a second configuration corresponding to the counter-clockwise operating mode, said actuator being moveable other than about the rotation axis of the actuator from a normal operating position in which the actuator is inhibited against configuring between its first and second configurations and an adjustment position in which the actuator is configurable between its first and second configurations.

13. The lock assembly set forth in claim 12 wherein the actuator is moveable relative to the actuator contact mechanism other than about the rotation axis of the actuator to its adjustment position in which at least one of the ring is rotatable relative to the actuator and the actuator is rotatable about its rotation axis relative to the actuator contact mechanism without contact between the actuator and contact mechanism to facilitate configuring of the actuator between its first and second configurations without removing the actuator from the lock assembly.

14. The lock assembly set forth in claim 12 wherein the lock assembly further comprises an actuator biasing member for biasing the actuator toward its normal operating position.

15. The lock assembly set forth in claim 1 wherein the lock assembly is operable between the clockwise operating mode and the counter-clockwise operating mode without removing any lock assembly components from the lock assembly.

16. The lock assembly set forth in claim 15 wherein the lock assembly is operable between the clockwise operating mode and the counter-clockwise operating mode without adjusting any lock assembly components of the lock assembly.

17. The lock assembly set forth in claim 16 wherein the actuator contact mechanism comprises exactly two fingers disposed in spaced relationship with each other and operatively connected to the ring for conjoint rotation therewith, in the initial position of the ring and the locked position of the actuator the actuator being received between the fingers such that upon rotation of the ring in the clockwise direction one of the fingers contacts the actuator to move the actuator to its locked position corresponding to the locked position of the deadbolt and upon rotation of the ring in the counter-clockwise direction the opposite one of the fingers contacts the actuator to move the actuator to its locked position corresponding to the locked position of the deadbolt.

18. The lock assembly set forth in claim 1 wherein the biasing member comprises at least one spring, in the clockwise operating mode of the lock assembly wherein the ring is rotated clockwise from its initial position toward its rotated position at least a first portion of the spring applying a biasing force to the ring generally in the counter-clockwise direction, in the counter-clockwise operating mode of the lock assembly wherein the ring is rotated counter-clockwise from its initial position toward its rotated position at least a second portion of the spring different from said first portion of said spring applying a biasing force to the ring generally in the clockwise direction.

19. The lock assembly set forth in claim 18 wherein the at least one spring is a compression spring.

20. The lock assembly set forth in claim 18 wherein the at least one spring is a tension spring.

21. The lock assembly set forth in claim 18 wherein the at least one spring is a torsion spring.

22. The lock assembly set forth in claim 1 wherein the biasing member comprises a pair of springs, in the clockwise operating mode of the lock assembly wherein the ring is rotated clockwise from its initial position toward its rotated position one of said springs applying a biasing force to the ring generally in the counter-clockwise direction, in the counter-clockwise operating mode of the lock assembly wherein the ring is rotated counter-clockwise from its initial position toward its rotated position the other one of said springs applying a biasing force to the ring generally in the clockwise direction.

23. The lock assembly set forth in claim 1 further comprising:

a lock cylinder having a torque blade operatively connected to the deadbolt, said actuator being operatively connected to the torque blade for operative connection with the deadbolt;

a locator for locating the lock assembly on a door;

at least one mounting screw for securing the lock assembly on the door, said at least one mounting screw having a longitudinal axis; and a stabilizing bridge having an opening corresponding to said at least one mounting screw such that said at least one mounting screw passes through the stabilizing bridge upon securing the lock assembly on the door, said stabilizing bridge inhibiting rotational movement of said at least one mounting screw in a direction transverse to the longitudinal axis of said at least one mounting screw.

24. The lock assembly set forth in claim 1 further comprising a backstop configurable between a first configuration corresponding to the clockwise operating mode of the lock assembly and a second configuration corresponding to the counter-clockwise operating mode of the lock assembly, in the first configuration of the backstop said backstop inhibiting counter-clockwise rotation of the ring from its initial position to indicate operation of the lock assembly in its clockwise operating mode, in the second configuration of the backstop said backstop inhibiting clockwise rotation of the ring from its initial position to indicate operation of the lock assembly in its counter-clockwise operating mode.

25. A deadbolt door lock assembly for keyless operation of a deadbolt from an unlocked position to a locked position of the deadbolt, the lock assembly comprising:

an actuator operatively connected to the deadbolt and having a rotation axis, the actuator being rotatable on said rotation axis from an unlocked position corresponding to the unlocked position of the deadbolt to a locked position corresponding to the locked position of the deadbolt;

a ring rotatable relative to the actuator from an initial position of the ring to a rotated position thereof;

an actuator contact mechanism operatively connected to the ring for conjoint rotation therewith, the actuator contact mechanism being configured and arranged for contact with the actuator in the unlocked position of the actuator upon rotation of the ring from its initial position toward its rotated position to rotate the actuator from the unlocked position of the actuator to its locked position; and a biasing member urging the actuator contact mechanism away from contact with the actuator in the locked position of the actuator;

the lock assembly being operable in a clockwise operating mode and a counter-clockwise operating mode, in the clockwise operating mode the ring being rotatable in a clockwise direction to rotate the actuator from its unlocked position to its locked position to lock the deadbolt, in the counter-clockwise operating mode the ring being rotatable in the counter-clockwise direction to rotate the actuator from its unlocked position to its locked position to lock the deadbolt, the biasing member having a first portion that applies a biasing force to the ring generally in the counter-clockwise direction in response to clockwise rotation of the ring in the clockwise operating mode of the lock assembly, and a second portion different from the said first portion that applies a biasing force to the ring generally in the clockwise direction in response to counter-clockwise rotation of the ring in the counter-clockwise operating mode of the lock assembly.

26. The lock assembly set forth in claim 25 wherein the biasing member comprises at least one spring, in the clockwise operating mode of the lock assembly wherein the ring is rotated clockwise from its initial position toward its rotated position a first portion of the spring applying a biasing force to the ring generally in the counter-clockwise direction, in the counter-clockwise operating mode of the lock assembly wherein the ring is rotated counter-clockwise from its initial position toward its rotated position a second portion of the spring different from said first portion of said spring applying a biasing force to the ring generally in the clockwise direction.

27. The lock assembly set forth in claim 26 wherein the at least one spring is a compression spring.

28. The lock assembly set forth in claim 26 wherein the at least one spring is a tension spring.

29. The lock assembly set forth in claim 26 wherein the at least one spring is a torsion spring.

30. The lock assembly set forth in claim 25 wherein the biasing member comprises a pair of springs, in the clockwise operating mode of the lock assembly wherein the ring is rotated clockwise from its initial position toward its rotated position one of said springs applying a biasing force to the ring generally in the counter-clockwise direction, in the counter-clockwise operating mode of the lock assembly wherein the ring is rotated counter-clockwise from its initial position toward its rotated position the other one of said springs applying a biasing force to the ring generally in the clockwise direction.

31. A deadbolt door lock assembly for keyless operation of a deadbolt from an unlocked position to a locked position of the deadbolt, the lock assembly comprising:

an actuator operatively connected to the deadbolt and having a rotation axis, the actuator being rotatable on said rotation axis from an unlocked position corresponding to the unlocked position of the deadbolt to a locked position corresponding to the locked position of the deadbolt;

a ring rotatable relative to the actuator from an initial position of the ring to a rotated position thereof;

an actuator contact mechanism operatively connected to the ring for conjoint rotation therewith, the actuator contact mechanism being configured and arranged for contact with the actuator in the unlocked position of the actuator upon rotation of the ring from its initial position toward its rotated position to rotate the actuator from the unlocked position of the actuator to its locked position, the lock assembly being operable in a clockwise operating mode and a counter-clockwise operating mode, in the clockwise operating mode the ring being rotatable in a clockwise direction to rotate the actuator from its unlocked position to its locked position to lock the deadbolt, in the counter-clockwise operating mode the ring being rotatable in the counter-clockwise direction to rotate the actuator from its unlocked position to its locked position to lock the deadbolt; and a backstop configurable between a first configuration corresponding to the clockwise operating mode of the lock assembly and a second configuration corresponding to the counter-clockwise operating mode of the lock assembly, in the first configuration of the backstop said backstop inhibiting counter-clockwise rotation of the ring from its initial position to indicate operation of the lock assembly in its clockwise operating mode, in the second configuration of the backstop said backstop inhibiting clockwise rotation of the ring from its initial position to indicate operation of the lock assembly in its counter-clockwise operating mode.

* * * * *